US008789480B2

(12) United States Patent
Kohnen et al.

(10) Patent No.: US 8,789,480 B2
(45) Date of Patent: Jul. 29, 2014

(54) ENERGY AND STEEL RECOVERY SYSTEM

(75) Inventors: Robert L. Kohnen, Springboro, OH (US); Dale Van Fossen, Granbury, TX (US); Michael Linton, Celina, OH (US)

(73) Assignee: Symbiotic Technology, LLC, Des Moines, IA (US)

( * ) Notice: Subject to any disclaimer, the term of this patent is extended or adjusted under 35 U.S.C. 154(b) by 437 days.

(21) Appl. No.: 12/862,822

(22) Filed: Aug. 25, 2010

(65) Prior Publication Data

US 2011/0209646 A1 Sep. 1, 2011

Related U.S. Application Data

(63) Continuation-in-part of application No. 10/908,525, filed on May 16, 2005, now Pat. No. 7,647,874, and a continuation-in-part of application No. 11/850,148, filed on Sep. 5, 2007, now abandoned.

(51) Int. Cl.

| | |
|---|---|
| ***F23G 5/027*** | (2006.01) |
| ***F23G 5/38*** | (2006.01) |
| ***F23H 13/00*** | (2006.01) |
| ***F23B 50/00*** | (2006.01) |
| ***F23K 5/00*** | (2006.01) |

(52) U.S. Cl.

USPC ..... 110/229; 110/280; 110/208; 110/109

(58) Field of Classification Search

CPC ..... F23B 50/12; F23G 5/027; F23G 5/0273; F23G 5/0276; F23G 7/005; F23G 2201/30; F23G 2201/301; F23G 2201/302; F23G 2201/303; F23G 2201/304; F23G 2201/40; F23G 2201/50; F23G 2202/103; F23G 2205/16; F23G 2209/28

USPC ..... 110/229, 280, 208, 225

See application file for complete search history.

(56) References Cited

U.S. PATENT DOCUMENTS

| | | | | |
|---|---|---|---|---|
| 2,124,122 | A * | 7/1938 | Raisch | 110/225 |
| 3,946,680 | A | 3/1976 | Laman | |
| 4,052,173 | A | 10/1977 | Schulz | |
| 4,091,747 | A * | 5/1978 | Chase | 110/210 |
| 4,201,141 | A * | 5/1980 | Teodorescu et al. | 110/259 |
| 4,203,804 | A | 5/1980 | Janning | |
| 4,261,268 | A * | 4/1981 | von Dreusche et al. | 110/216 |
| 4,272,555 | A * | 6/1981 | Davis et al. | 423/418.2 |
| 4,488,398 | A | 12/1984 | Noguchi | |
| 4,530,702 | A | 7/1985 | Fetters | |
| 4,635,573 | A | 1/1987 | Santen | |
| 4,650,546 | A | 3/1987 | LeJeune | |
| 4,732,091 | A * | 3/1988 | Gould | 110/229 |
| 4,732,092 | A * | 3/1988 | Gould | 110/229 |
| 5,167,772 | A | 12/1992 | Parker | |
| 5,195,449 | A | 3/1993 | Michimae | |
| 5,226,375 | A | 7/1993 | Fukuda | |
| 5,230,777 | A | 7/1993 | Jarrell | |
| 5,380,352 | A | 1/1995 | Greenwalt | |
| 5,852,062 | A | 12/1998 | Carpenter | |
| 6,832,564 | B2 | 12/2004 | Hutmacher et al. | |
| 6,932,002 | B2 * | 8/2005 | May et al. | 110/345 |

* cited by examiner

*Primary Examiner* — Kenneth Rinehart
*Assistant Examiner* — David J Laux
(74) *Attorney, Agent, or Firm* — R. William Graham

(57) ABSTRACT

An energy and steel recovery system has a suspension column and a plurality of suspension supports operably disposed therein wherein the supports are spaced from one another along the length of thereof. The suspension column includes a mechanism for receiving tires and other wastes with an energy value onto one of the supports and feeding the tires to an adjacent downwardly disposed support to further gasify the same under low oxygen to preclude combustion. The column is configured to provide for a number of zones including heating, drying, volatizing, and fixed carbon formation which are collectively referred to herein as a "fractionation process."

17 Claims, 19 Drawing Sheets

72
Unit Outlet Sample Point
Safety
Rupture
Disk
Economizer
Boiler
75
Tire Ram
22
Handle
54
14
Gate
Airlock
Inner Door
Tire
Support
20
12
Outer Door
73
Combustion Zone
10
Unit Inlet Sample Point
Cooling Air
Single Tire R&D Unit 10
Cyclone
85
Rupture
Disk
72
83
Fixed Carbon Particles
Organic Vapors
94
Fixed Carbon Particles
14
77
Double Gate Airlock
w/ Fork Extraction
75
87
18A
Tires
Scale
18B
Fuel
18C
18D
73
18E
Fork Extraction
89
18F
18G
Hot gas
Ram
105
104
Airlock
Steel Recovered
Tire Fractionation System

FIG. 9 GRAPH 2-1A CHAMBER INLET MINUTE-BY-MINUTE AVERAGES

QUARTER TIRE TEST

FIG. 10 GRAPH 2-1 B CHAMBER INLET MINUTE-BY-MINUTE AVERAGES
QUARTER TIRE TEST WITH NOx

FIG. 11 GRAPH 2-2 CHAMBER INLET MINUTE-BY-MINUTE AVERAGES

WHOLE TIRE TEST

FIG. 12 GRAPH 2-3. CHAMBER INLET MINUTE-BY-MINUTE AVERAGES

WHOLE TIRE SECOND TEST DAY

FIG. 13 GRAPH 2-4. CHAMBER OUTLET GASEOUS POLLUTANTS MINUTE-BY-MINUTE AVERAGES QUARTER TIRE TEST

FIG. 14 GRAPH 2-5. CHAMBER OUTLET GASEOUS POLLUTANTS MINUTE-BY-MINUTE AVERAGES

WHOLE TIRE TEST

FIG. 15 GRAPH 2-6. CHAMBER OUTLET GASEOUS POLLUTANTS MINUTE-BY-MINUTE AVERAGES WHOLE TIRE TEST

Sketch No. 2-1

ENERGY AND STEEL RECOVERY SYSTEM

This is a continuation-in-part of U.S. Ser. No. 10/908,525 filed May 16, 2005 now U.S. Pat. No. 7,647,874 and U.S. Ser. No. 11/850,148 filed Sep. 5, 2007 now abandoned.

BACKGROUND OF INVENTION

1. Field of Invention

This invention relates to improvements in energy and steel recovery systems. More particularly, the invention relates to a system for recovering energy and steel through volatizing and liberation of the fixed carbon from the steel in tires while held in suspension in a slipstream of a high energy user. This invention allows an efficient use of the potential energy held in waste materials, preferably solids such as whole vehicle tires, and also other waste materials in bulk or crushed form, such as waste plastics and paper, to reduce fuel consumption expenses in large capacity boiler systems.

2. Related Art

Alternative waste derived fuels have been operably disposed within a pyrolysis or combustion chamber or a riser duct. The use of such waste products is a function of the burning environment, for example, the amount of heat required and oxygen content within the chamber or kiln. Tires are currently being made use of as alternative fuels to reduce usage of traditional fuels. Tires have been found to be highly suitable. In co-pending U.S. application Ser. No. 11/850,148, there is disclosed a process to inject tires into a column that was located next to a utility steam generator and combust them in a slipstream of gas drawn from the boiler. Tires, while being suspended in the gas stream by a number of forks that would methodically retract, would combust as they progress down the inside of the column, counter current to the gas stream. The heat generated by the tire would then be recovered in the boiler and the steel and any ash would be removed at the bottom of the column for ultimate recycling or disposal. Prior systems use combustion of tires fail to fully recover energy to reuse tire resources.

There remains a need to improve such technology to provide a highly efficient, easily operated, low cost, system for using such fuels.

SUMMARY OF THE INVENTION

The instant invention introduces a novel process and system which provides for fractionation of waste processable material and more particularly to "tire fractionation" or "fractionation" for other waste materials, which does not involve shredding or burning tires, and it has many environmental benefits. Tire fractionation technology converts tires directly into a clean gaseous high-Btu fuel, and it also recovers the high-quality steel belts for reuse. Fractionated tire fuel is a renewable and sustainable as the tire replacement cycle.

Tire fractionation is a closed-loop system that generates essentially no emissions. All of the tire components are recovered either as a fuel or as recycled steel. The process involves the controlled exposure of tires to heat that converts the non-metallic portion of the tires to combustible gas containing fixed carbon particles.

As an energy source, tires have a good potential compared to some other fuel sources. An important point to note is that tires have a higher heating fuel value of approximately 12,000 to 16,000 Btu per pound of tire as compared to 12,000 Btu per pound of coal and just 5,000 Btu per pound of wood. The steel content of a tire is approximately 15% by weight. Hence, for a system processing 4,000,000 tires per year, approximately 6000 tons of steel is recovered and recycled by the iron and steel industry.

This technology is used to generate supplemental fuel for coal-fired boilers at electric generation stations. Fractionated tire fuel also helps in reducing air contaminant emissions. When used as a supplemental fuel in a coal-fired boiler, fractionated tire fuel displaces a portion of the coal that otherwise would have been burned in the boiler. Fractionated tire fuel creates significantly lower pollutant emission profiles, when compared to coal. The lower emission profile, including carbon dioxide, sulfur dioxide, nitrogen oxides, and particulate matter, overall pollutant emissions from the boiler are reduced. Another advantage is that the reduced volume of coal burned in a boiler using fractionated tire fuel also reduces the amount of coal ash that must be managed in ash lagoons or disposed of in ash landfills, thereby extending the useful life of those facilities, requiring fewer new lagoons and landfills to be created, and reducing the hazard of coal ash spills.

An object of the invention is to improve energy recovery in the fractionation of waste processable fuel through gasification including heating, drying, volatizing and liberation of the fixed carbon from the steel in waste fuel and wherein the fractionation process is maintained with an oxygen content level low enough to preclude combustion of the waste processable fuel therein.

Another object is to improve the method of recovery of energy in fractionation of waste processable fuel through gasification including heating, drying, volatizing and fixed carbon formation of a waste in a column through gasification and a controlled movement of vaporized and residual byproducts into a combustion zone of a boiler so that the radiant energy of the waste processable fuel is recovered in the boiler.

A further object is to provide a system and method for a novel waste fuel fractionation process.

Yet another object of the invention is to improve boiler technology.

Another object is to improve efficiency of boiler technology.

Still another objective of this invention is to enhance the process in which waste tire material is gasified with heat and drying within a suspension system and where volitization and fixed carbon liberation is performed in the column to provide the fractionation process wherein there is maintained an oxygen content level low enough to preclude combustion of the waste tire fuel therein.

Accordingly, the invention is directed to an energy and steel recovery system. The system has a suspension column and a plurality of suspension supports operably disposed in the suspension column wherein the supports are spaced from one another along the length of the suspension column. The suspension column includes means for receiving the waste processable material onto one of the supports and feeding, e.g., via gravity feeding, the waste processable material to an adjacent downwardly disposed support to further fractionate the waste processable material. More specifically, the column is configured to provide for a number of zones including heating, drying, volatizing, and fixed carbon liberation which are performed under conditions wherein the oxygen content is maintained below that required for combustion of the waste processable material (hereinafter "low oxygen"). This process is referred to herein as a "fractionation process." A first conduit includes a first end communicably connected to a heated air path which is under the low oxygen of the suspension column and a second end communicably connected to an outflow air path of a boiler wherein air flow passes from the outflow air path of the boiler to heated air flow path of the suspension column. A second conduit includes a first end communicably connected to the heated air flow path of the suspension column and a second end communicably connected to a return air flow path of the boiler wherein air flow passes from the heated air flow path of the suspension column to the return air flow path of the boiler. The boiler can include a combusting zone and an economizer with dual economizers feeding heat and low oxygen to a lower end of the column. The system is further equipped with a device for removing residual materials, e.g., steel, from the suspension column.

Preferably, the suspension column can be equipped with an outer air passage jacket surrounding an inner column wall to which the first and second conduits are communicably connected. In this way, air or other medium enters the jacket and passes through the jacket being heated from the outer surface of the inner wall without mixing with air from the volatizing and fixed carbon formation occurring within the inner wall. Each suspension support includes a plurality of support fingers each having a waste derived fuel support surface which is removably disposed in the suspension column to provide for self cleaning of the support surface of the fingers upon removal from the suspension column. Preferably, the suspension support includes means for automatically retracting the fingers from the column. Further, means for automatically feeding the waste material on to the fingers of the suspension support are provided.

The present invention is particularly useful in providing additional heating energy to high energy user systems, such as boilers and using a novel a structure and method and provides an automated feed of waste materials, preferably tires, into a suspension column. Upon processing tires, residual metals from within the tires pass by virtue of their weight and gravity to either a residual waste removal conveyor, or a multiple gate airlock, where the metals, i.e., steel wires from tires can be removed. With the use of the invention, it is contemplated that the alternative waste energy including at least partially processable organic-containing waste can provide a substantial amount of the heat required for heating high energy user systems, such as a boiler. Novelty of the invention will be apparent hereinafter as discussed more fully below and other objectives and advantages of this invention will be apparent from reading the drawings and description hereinafter.

DETAILED DESCRIPTION OF THE PREFERRED EMBODIMENTS

Figure 1:
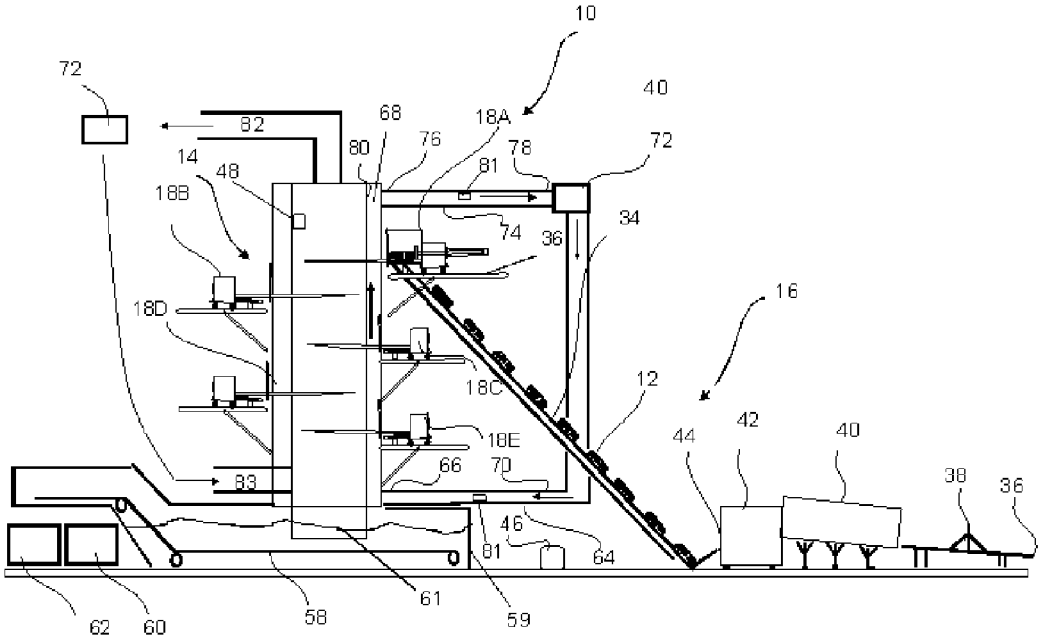
FIG. 1 is a side elevation diagrammatic view embodying the invention, especially the suspension column with suspension supports.

Referring now to the drawings, an energy and steel recovery system is generally referred to by the numeral 10. The present invention provides an improved way to recover the energy in the waste processable fuel, such as a tire(s) 12, by gasifying under low oxygen the tire and moving both the tire's vaporized organics and fixed carbon into the combustion zone 73 of a boiler 72. Radiant energy of the tire is recovered in the boiler 72 eliminating ash in a column 14 and a higher quality of steel is produced. The column 14 is configured to provide for a number of zones 100, 101, 102 and 103 including gasifying through heating 100, drying 101, volatizing 102, and fixed carbon formation 103. Tires 12 can be fractionated under sufficiently low oxygen content such that no combustion occurs, and high velocity and high temperature, i.e., approximately 1,100° F. conditions, producing a gaseous and solid fuel for the boiler 72 while producing no negative effects to the boiler 72 and generating a high quality of residual recyclable steel from the tire 12. The present invention coins the process described herein as "tire fractionation."

A sample of ash produced by the process was collected and analyzed. It contained no detectable Mercury, 12,300 mg/Kg of Zinc and conformed to ERA standards for metals, VOC and SVOC TCLP testing. Because tires, with the provision of a higher BTU value and a higher Zinc content, compare favorable with coal, Tire Derived Fuel (TDF) can be utilized worldwide as a supplemental fuel in coal burning operations.

The process waste streams tires 12, (and conceptually other scrap plastics, paper, etc.) to recover their energy, mineral and steel components. The system 10 uses a hot, low oxygen gas stream for its motive force. The hot gas volatilizes organics in the tire 12 and vapor is entrained in the gas stream.

Once the organic solvents are stripped from the tire 12, a fixed carbon char remains. The fixed carbon char fraction is also entrained in the gas stream. Any steel is left in the column 14 and removed through an airlock assembly 104. The gas stream, carrying the vapors and fixed carbon fraction, is introduced into combustion zone 73 of a high energy user (boiler 72) and the energy value is recovered.

As an alternative process, the system 10 can pass the carrier gas through a cyclone 85 to separate the fixed carbon from the stream. In so doing so, any heavy metals can be recovered from the solid portion, such as zinc in a tire 12. Because the vapor portion is between its upper explosion limit (UEL) and lower explosion limit (LEL), the oxygen content is monitored in the system. If the oxygen level increases due to tramp air, an inert gas, such as nitrogen, is introduced to dilute the oxygen level and bring the system 10 into the proper safe operating range.

The invention contemplates both a batch solids fractionation system and/or a continuous solids fractionation system. In a batch unit, one would charge the system 10, run the system 10 until all of the organics are vaporized and shut it down to remove any residuals such as the steel in the tires. In a continuous unit, one would continually feed and remove the feedstock and residuals through double or triple gate airlocks while generating a continuous waste derived fuel gas.

The off gas stream can be reintroduced as a reflux to enrich the vapor and solids fraction of the fuel enriched discharge gas. Either both the gas and solids can be refluxed or the solids can be removed and only the gas refluxed. The system 10 provides the benefits of maximum energy, mineral and steel recovery and recycling of steel. Importantly, this is done without burning of the waste fuel while minimizing emissions. By replacing coal in a boiler, there is provided reduced SOx, NOx and Carbon Dioxide emissions and reduced production of coal ash. These vaporized organics produces a fuel which is combusted in the onsite boiler 85 and the recovered steel is sent to a metal recycling facility. By virtue of the system 10, no tires are needed to be stored on the ground, but are kept in enclosed trucks until loaded into the material handling feeding mechanism 16 of the system 10. This new process reduces the amount of waste going to the landfills, reduces the use of conventional fuels for the end user, reduces the boiler's carbon footprint, reduces the boilers NOx emissions, reclaims all of the organic and mineral value of the waste material.

The fractionation of the invention converts whole tires to clean fuel without burning. Millions of tires are replaced each year (on average, one per person in the U.S.). Without proper management, used tires can create significant environmental, health, and safety problems. However, used tires can be reclaimed in the form of valuable energy and reusable steel in a sustainable and very competitive economic model.

Tire fractionation process of the instant invention converts tires directly into a clean gas fuel, and also recovers the high-quality steel belts for reuse. All tire components are recovered either as a clean fuel or as recycled steel.

The process of the instant system 10 involves the controlled exposure of tires to a gas heat stream that converts the non-metallic portion of the tires 12 to gaseous fuel and carbon particles. Vertical column 14 is installed adjacent to boiler 72. A slip of combustion off gas from the boiler 72 is directed to the base of the column 14 and rises through the column 14. This gas stream is high in temperature while being low in oxygen (below that required for combustion of the tires 12). Whole tires 12 are suspended on a vertical conveyer 16 system and lowered through the column 14.

By the time a tire 12 reaches the base of the column 14, the heat has converted the entire organic portion of the tire 12 to a gas and fine carbon particles. The gas has a sufficient energy value to serve as a fuel, and is piped to the boiler 72 for combustion. The metallic belts in the tire 12 are not combusted or converted to gas, but rather accumulate at the bottom of the column and are later removed for recycling offsite.

The invention prevents tires from becoming waste and environmental problems. Tires stored or discarded on the surface of the ground are ugly, do not decompose, and present the hazards of uncontrolled fires and the breeding of mosquitoes. When using the fractionation of the instant invention for the recycling of scrap tires, environmental benefits exist which include:

reduced C02 emissions conservation of fossil fuels reduced SOx and NOx emissions reduced production of coal ash recovery of the steel in the tires environmentally acceptable method for the disposing of tires.

The energy and steel recovery system 10 is more specifically described hereinafter. The alternative fuel, which can preferably be processable waste tires 12, is fed to suspension column 14 by feeding mechanism 16 which includes a conveyor. The suspension column 14 can preferably include and one or more, preferably a plurality of suspension supports 18A, 18B, 18C, 18D, 18E, 18F, 18G, 18H, 18I, 18J, 18K, 18L, 18M which are operably disposed in the suspension column 14 wherein the suspension supports 18A, 18B, 18C, 18D, 18E, 18F, 18G, 18H, 18I, 18J, 18K, 18L, 18M are spaced from one another along the vertical length of the suspension column 14. The number of suspension supports 18A, 18B, 18C, 18D, 18E, 18F, 18G, 18H, 18I, 18J, 18K, 18L, 18M and spacing therebetween can be varied to accommodate the length and size of the suspension column 14 as well as the material to be processed through the fractionation. For example, spacing can be to provide that the tires 12 be readily removable from an upwardly disposed suspension support 18A to support 18B and so on. Each of the suspension supports 18A, 18B, 18C, 18D, 18E, 18F, 18G, 18H, 18I, 18J, 18K, 18M can be similar in design and operation and like numbers are intended to describe like parts with the exception that support 18A is connected to additional components described hereinafter.

In this regard, suspension support 18A connects to housing 24 which includes an exterior gate 20 and an interior gate or door 22 which close to provide an airlock during injection of tire 12 into the suspension column 14. The exterior gate 20 is opened while the interior gate 22 is closed to pass waste derived fuel material into a support housing 24. The exterior gate 20 is closed while the interior gate 22 is opened to pass tires 12 from support housing 24 into the suspension column 14. This is illustrated in FIGS. 2A-4.

The suspension support 18A, for example, includes a plurality of support fingers 26A each having a waste support surface 28A which are removably disposed in the suspension column 14 through slotted open surface 32A to provide for self cleaning of the support surface 28A of the fingers 26A upon removal from the column 14. In this regard, slotted surfaces 32A can be formed in a face of the column 14 through which the fingers 26A move back and forth to effect the removal of the residual waste 13.

Preferably, the suspension support 18A includes equipment 30A for automatically retracting the fingers 26A from the column 14. The equipment 30A can include a motor 31A and a linear actuator 33A which is operably interconnected to the movable housing 52 and fingers 26A. The equipment 30A sit on a platform 56.

As for the feeding tires 12, feeding mechanism 16 is provided for automatically feeding the tires 12 to the support 18A onto the fingers 26A of the suspension support 18A. Feeding mechanism 16 can include an inclined elevator belt 34 wherein the tires 12 are placed and elevated thereby to the support housing 24 through gate 20. A truck ramp 36 is operably disposed adjacent a trailer tipper 38 for enabling dumping tires 12 into a hopper 40. A rotating disk tire separator 42 is operably disposed to the hopper 40 and separates tires 12 into an accumulator 44 for inspection. Unsuitable tires can rejected onto a reject conveyor belt (not shown), while accepted tires 12 are fed onto the inclined conveyor belt 34. Such feed is controlled by means of a controller 46 which is operably connected to a sensor 48 located in the suspension column 14 to sense when the conditions are suitable for volatizing and fixed carbon formation to take place for the next in line tire 12.

Figure 2A:
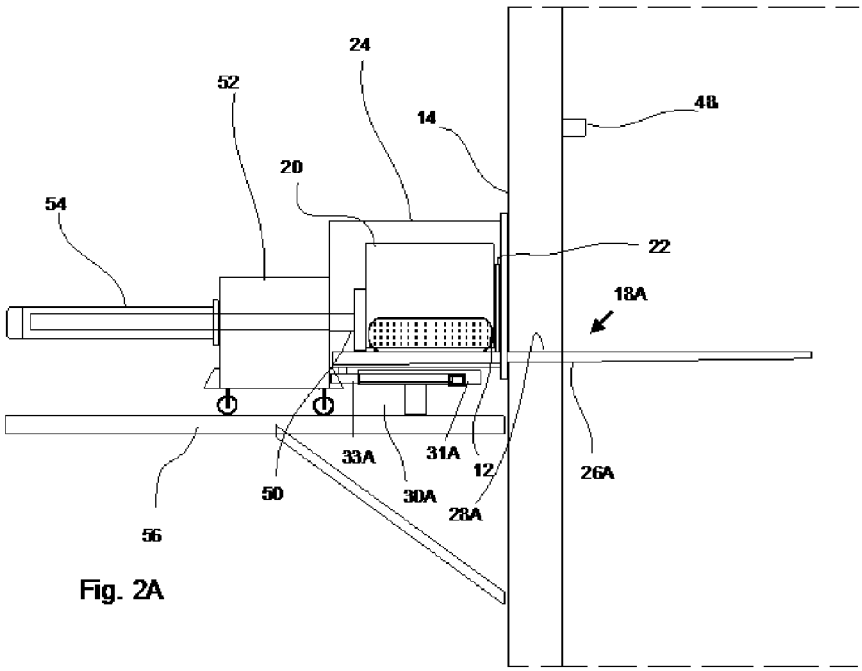
FIG. 2A is a view illustrating a first mode of a support of the instant invention.
Figure 2B:
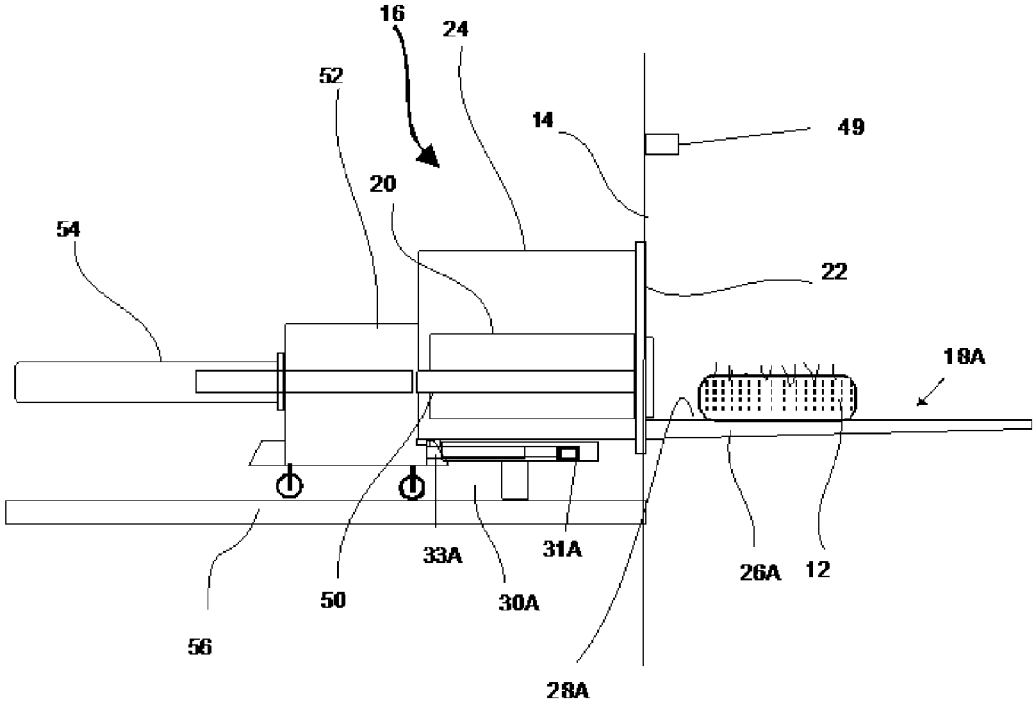
FIG. 2B is a view illustrating a second mode of the support of FIG. 2A.

As seen in FIGS. 2A and 2B, a linear actuated ram 50 is partially operably disposed in housing 52 and casing 54 connected to the housing 24 and is controllably moved back and forth through support housing 24. The controller 46 receives a signal to feed a tire 12 and initiate the ram 50 to push the tire 12 from the support housing 24 into the suspension column 14 and onto the suspension fingers 26A. The tire 12 is thereafter subjected to the fractionation process within the suspension column 14. Tires 12 may also be introduced mechanically onto the suspension support 18A by other means such as a screw feed or other similar device (not shown) and with maintaining the airlock method.

Figure 6:
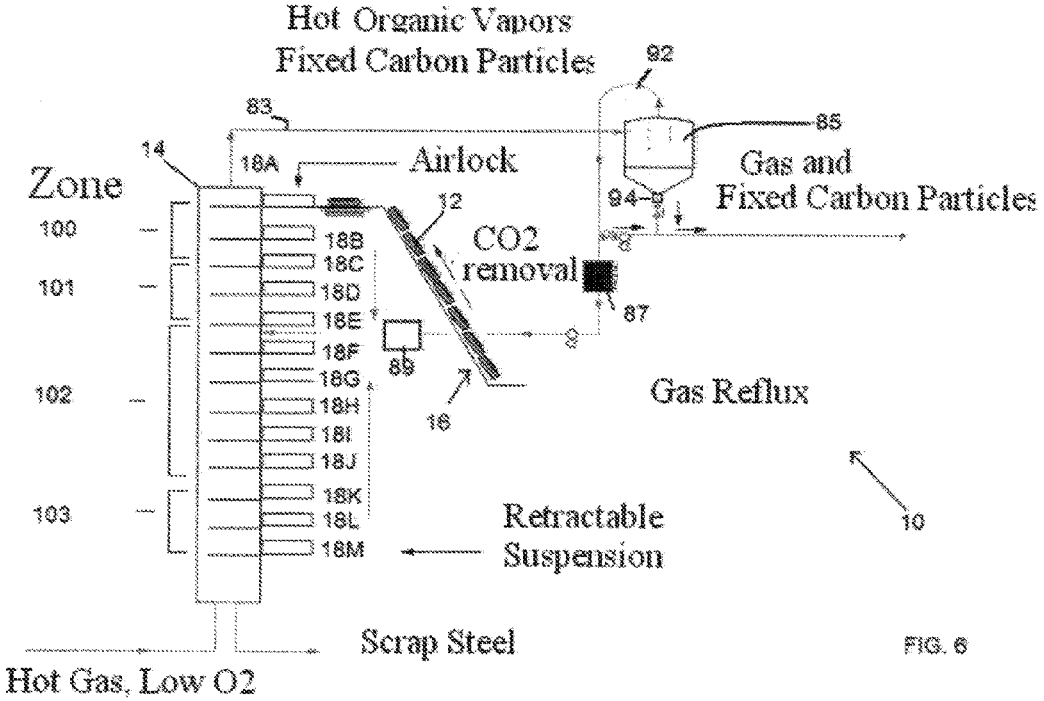
FIG. 6 is a side elevation diagrammatic view embodying another aspect of the invention.
Figure 7:
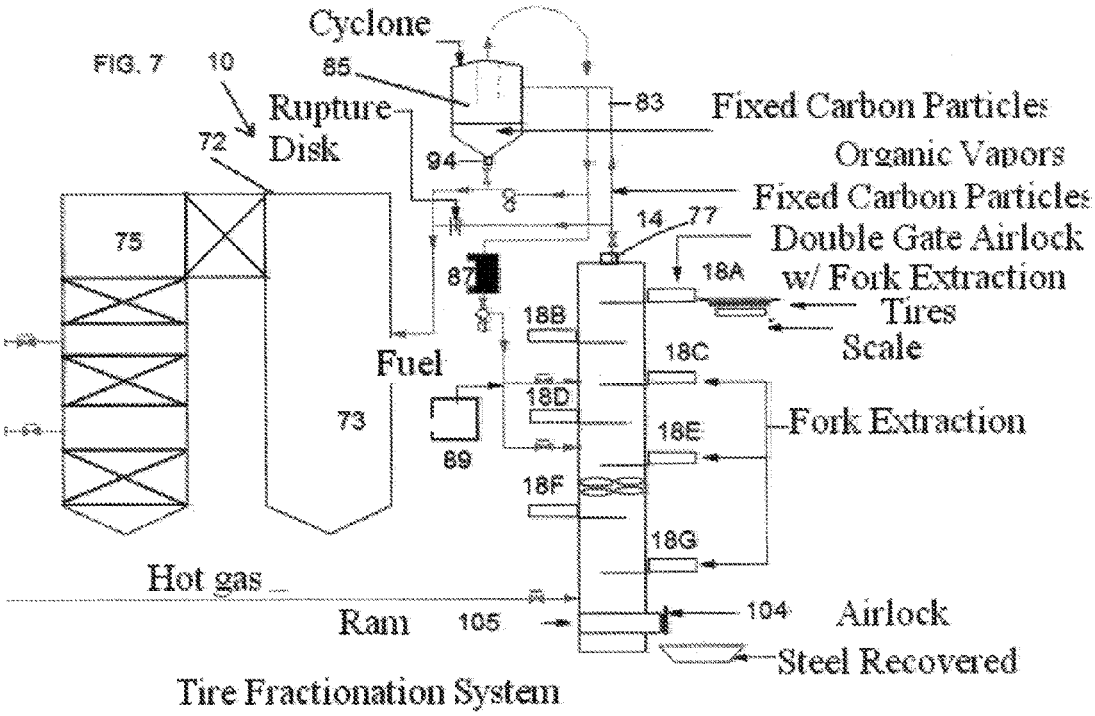
FIG. 7 is a side elevation diagrammatic view embodying still another aspect of the invention.
Figure 8:
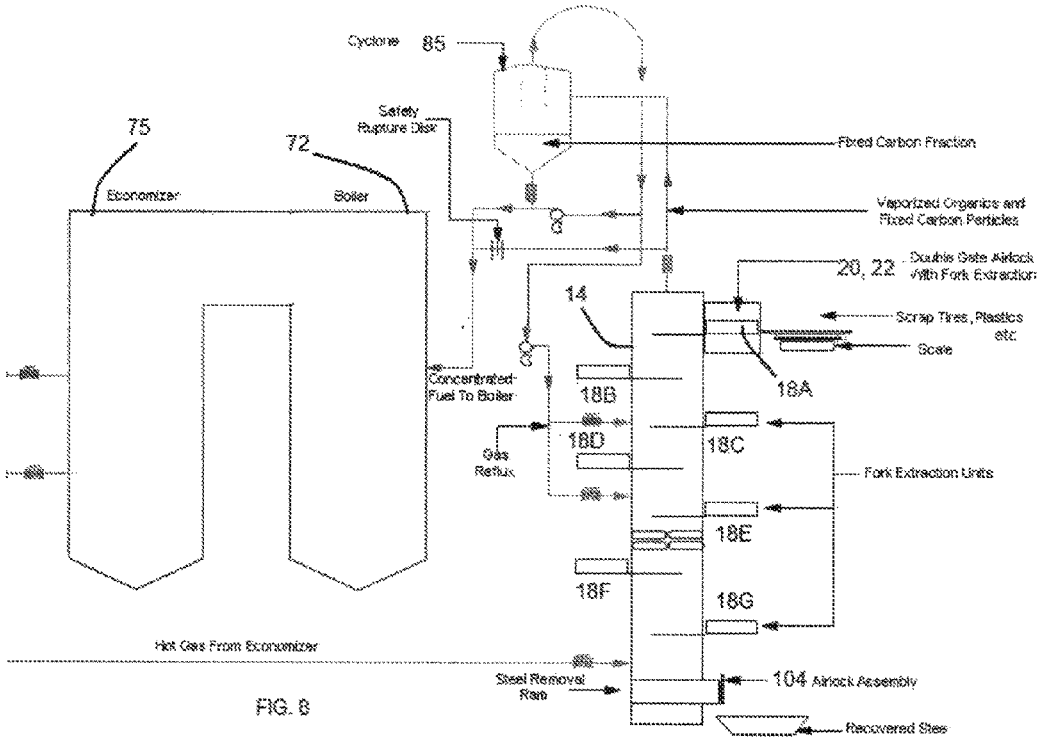
FIG. 8 is a side elevation view of another embodiment of the invention.
Figure 9:
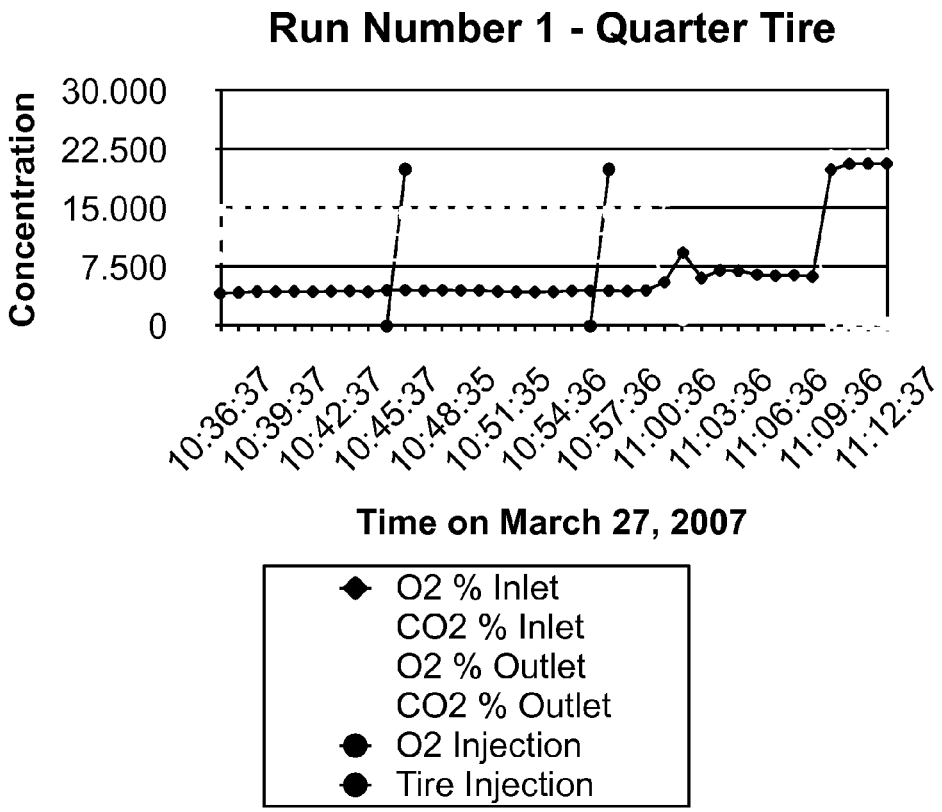
FIG. 9 is a graph of chamber inlet minute-by-minute averages quarter tire test.
Figure 10:
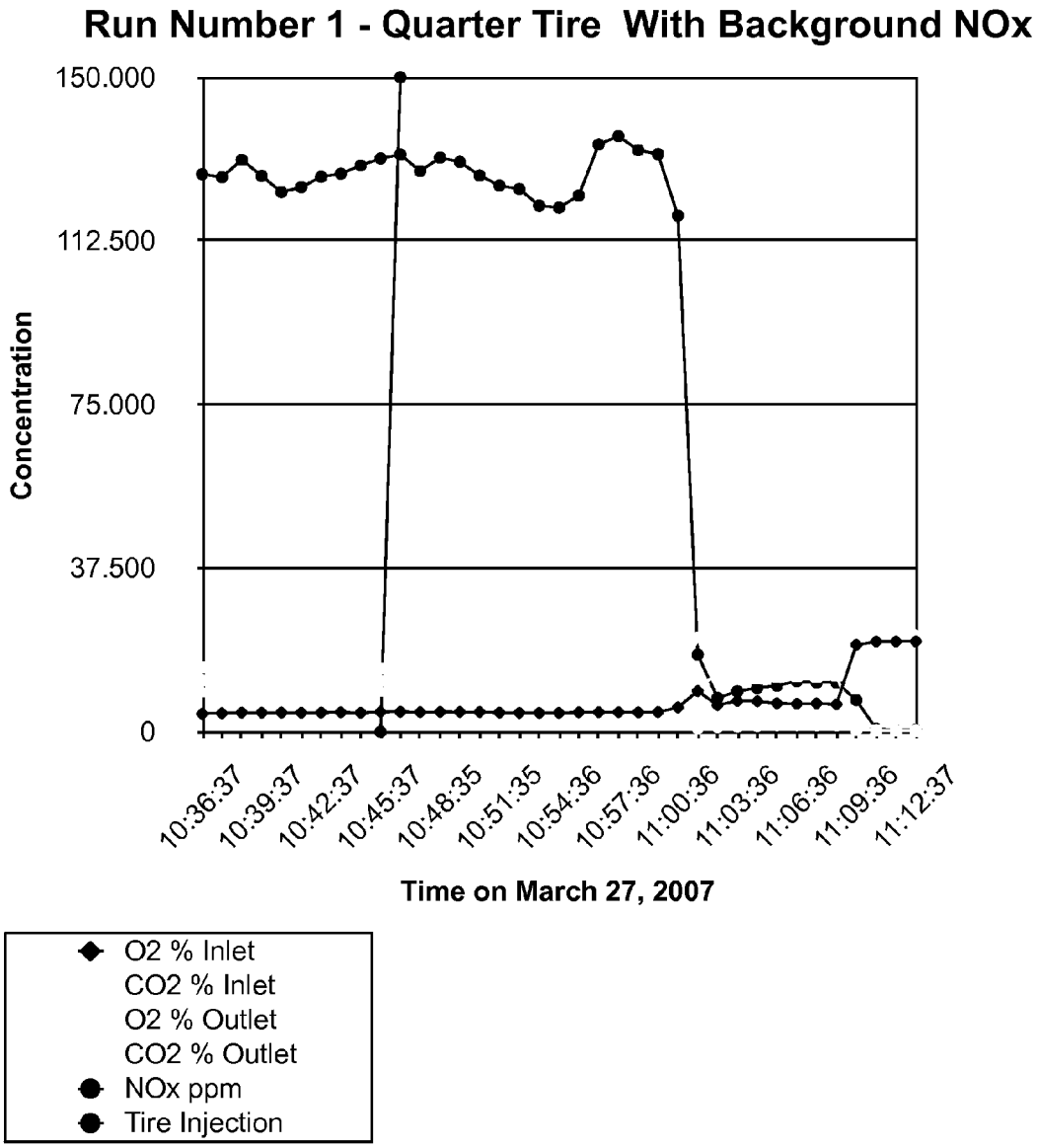
FIG. 10 depicts chamber inlet minute-by-minute averages tire test NOx.
Figure 11:
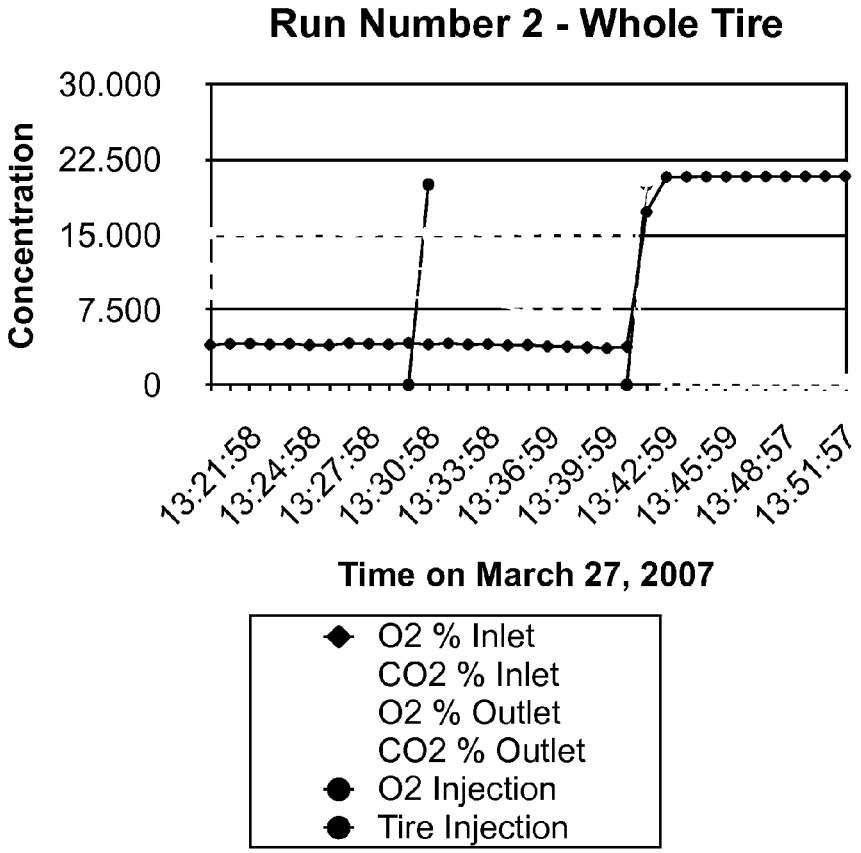
FIG. 11 depicts chamber inlet minute-by-minute averages whole tire test.
Figure 12:
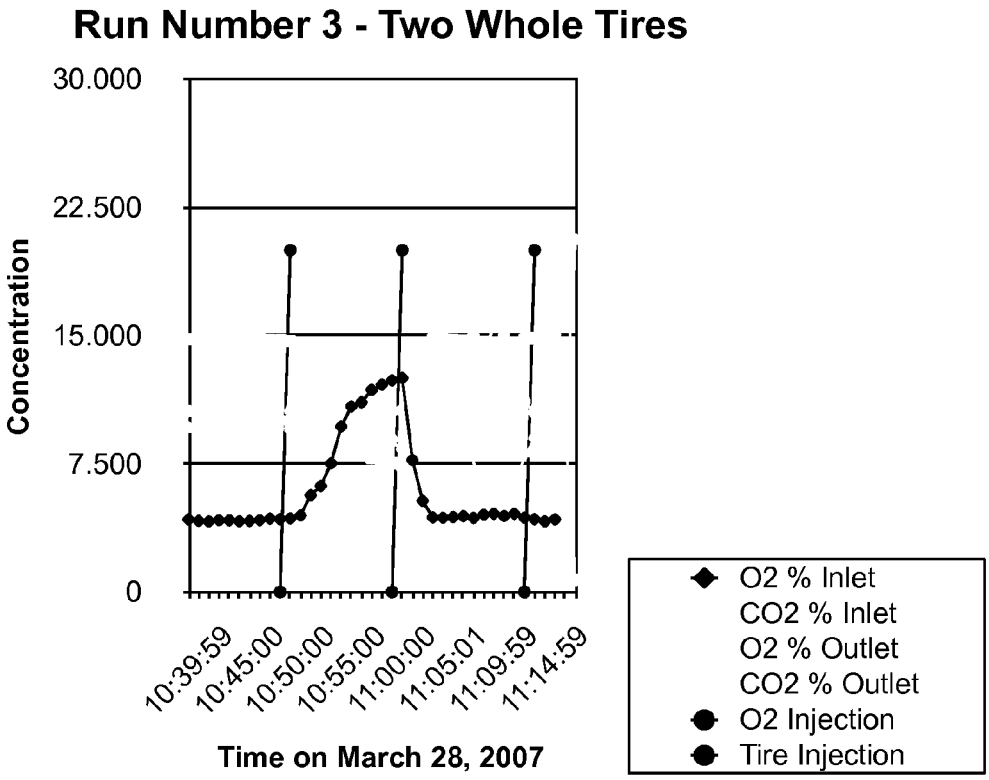
FIG. 12 depicts chamber inlet minute-by-minute averages whole tire second test day.
Figure 13:
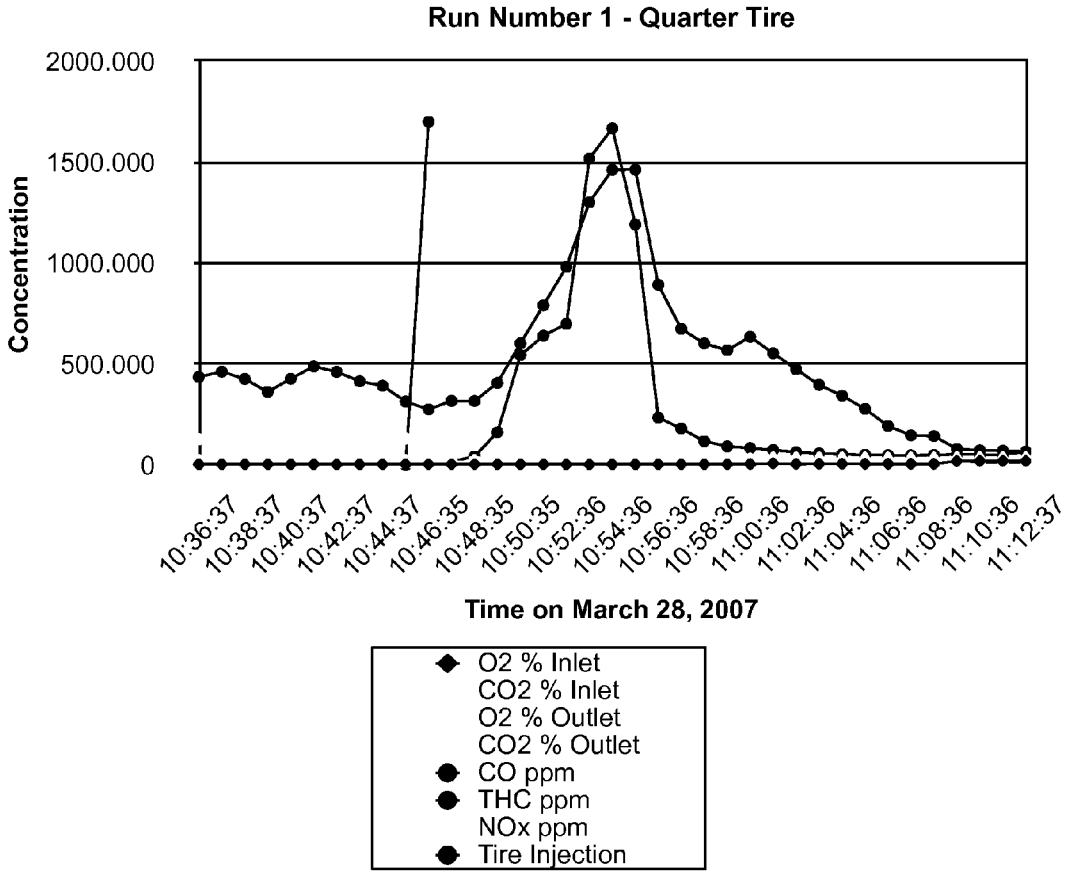
FIG. 13 depicts chamber outlet gaseous pollutants minute-by-minute averages quarter tire test.
Figure 14:
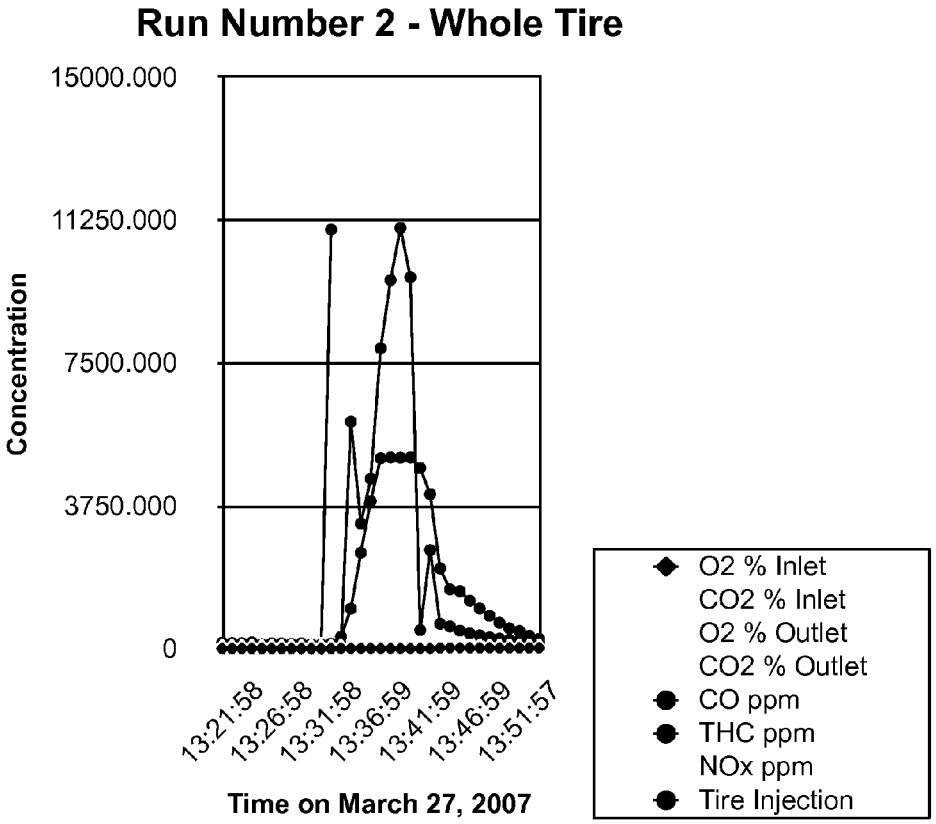
FIG. 14 depicts chamber outlet gaseous pollutants minute-by-minute averages whole tire test.
Figure 15:
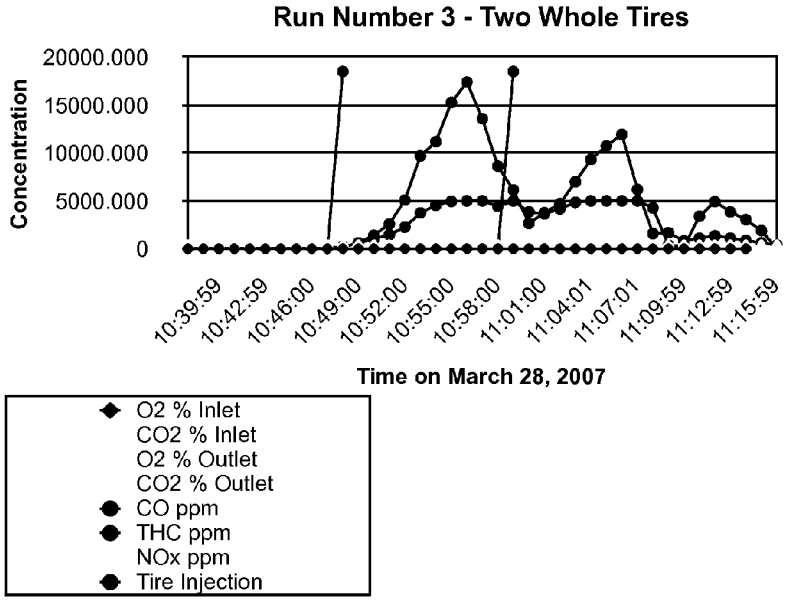
FIG. 15 depicts chamber outlet gaseous pollutants minute-by-minute averages whole tire test.
Figure 16:
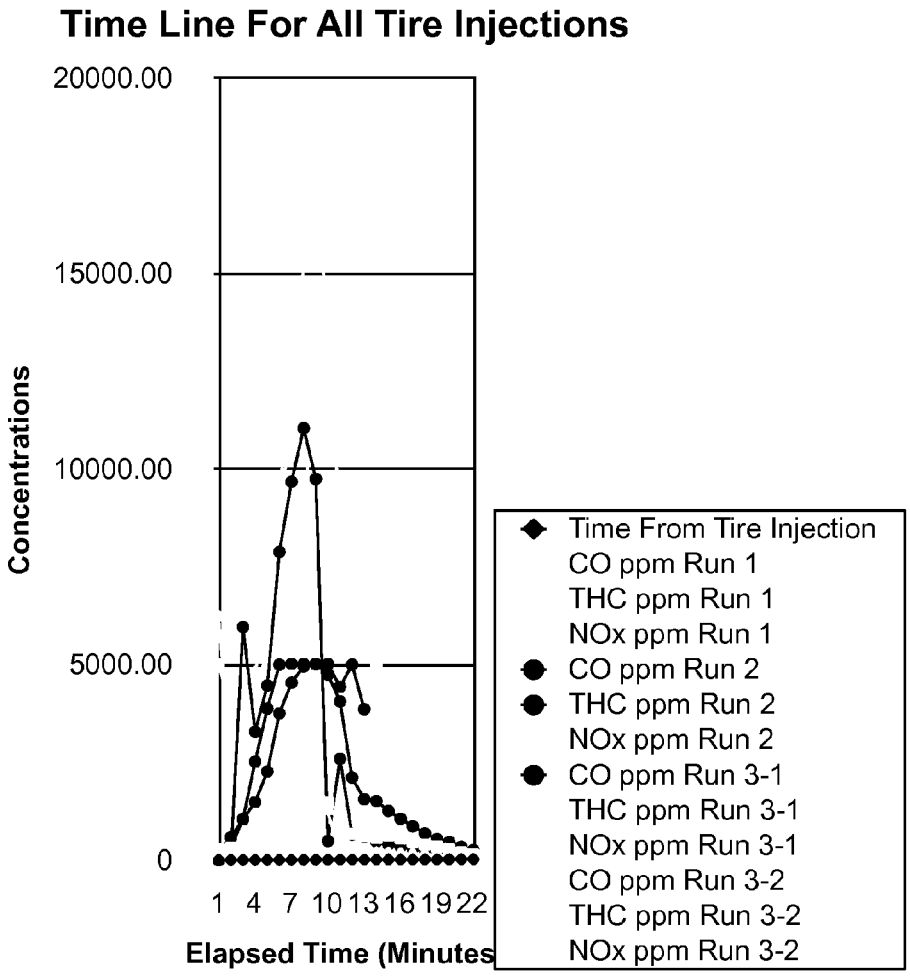
FIG. 16 depicts a time line for all tire injections.

In this regard, the boiler 72 can include combustion zone 73 and an economizer zone 75 with dual economizers feeding heat and "low oxygen" to a lower end of the column 14. Boiler 72 can be equipped with one or more slip streams of hot gases taken from economizer zone 75 of boiler 72 and introduced into a lower end of the column 14 as seen in FIG. 7. The tire(s) 12 is exposed to the hot gas stream until the rubber is gasified and subjected to the fractionation process. As seen in FIGS. 6-8, a vent 82 from the column 14 can be routed back to the boiler combustion zone 73 as a fuel supplement. As an alternative, conduit 83 connected to the upper portion of the column 14 to remove hot organic vapor and fixed carbon particulate, can be connected to a cyclone 85 which passes gas and fixed carbon particulate to the combustion zone 73 of the boiler 72. A $CO_2$ removal apparatus 87 can be operably connected to the cyclone 85 to remove $CO_2$ from the gas reflux 89 to the column 14 further providing lower emissions for the boiler 72.

low oxygen and high slip stream gas velocity settings conducted during the first condition. The third test condition consisted of the introduction of one whole tire into the unit under high temperature, low oxygen and low slip stream gas flow conditions. After the first tire was gasified, a second tire was immediately introduced into the unit.

The tire gasification inlet stack was sampled for stack gas velocity, temperature, O2 and CO2 content. The tire gasification outlet stack was sampled for stack gas velocity, temperature, semi-volatile organic compounds, volatile organic compounds, hydrogen sulfide, fuel density, heat content, and gaseous pollutants (O2, CO2, NOx, CO, VOC). Tables 2-1, 2-2 and 2-3 present the minute-by-minute stack gas velocity, temperature and gaseous averages at the inlet chamber during all three test conditions. Tables 2-4, 2-5 and 2-6 present the minute-by-minute stack gas velocity, temperature and gaseous pollutant averages at the outlet chamber.

Whole scrap tires are delivered to the site by truck, rail, or barge depending on the availability and economics of the transportation network. The shipment is weighed, sorted, and inspected upon arrival. Arriving tires are stored in enclosed trailers or buildings. The tires are removed from storage and fed to the inclined conveyor at a feed rate of 600 tires per hour or approximately 12,000 pounds per hour. The fractionation column is a vertical cylindrical tower that is approximately 120 feet tall, and as depicted in FIG. 1 the column is installed adjacent to the boiler 72. A slip stream of hot (750 to 900° F.) boiler flue gas is directed to the base of the column as it rises through the column. As depicted in FIG. 2, whole tires are suspended on a vertical conveyer system and lowered through the column. The hot boiler gas stream flow is countercurrent to the descending tires within the enclosed tower. The column operates at sub-stoichiometric oxygen levels, causing the tires to distill off the volatiles or gasify rather than burn. By the time a tire reaches the base of the column, the heat has

TABLE 1-1

TIRE GASIFICATION TDF STREAM SAMPLING SCENARIO

| Trial Scenario | Target Analytes | Sample Time | EPA Reference Methods |
|---|---|---|---|
| 1-High Temperature/ Low $O_2$ Quarter Tire | OUTLET: Flow Rate, $O_2$, $CO_2$, CO, TOC, $H_2S$, $NO_x$, Absolute Pressure, Temperature INLET: Flow Rate, $O_2$, Temperature | ~28 min. | 1, 2C, 3A, 7E, 10, 15/16, 25A, 0010, 0031, ASTM D145 |
| 1-High Temperature/ Low $O_2$ Whole Tire | OUTLET: Flow Rate, $O_2$, $CO_2$, CO, TOC, $H_2S$, $NO_x$, Absolute Pressure, Temperature INLET: Flow Rate, $O_2$, Temperature | ~18 min | 1, 2C, 3A, 7E, 10, 15/16, 25A, 0010, 0031, ASTM D145 |
| 1-High Temperature/ Low $O_2$/ Low Flow Whole Tire | OUTLET: Flow Rate, $O_2$, $CO_2$, CO, TOC, $H_2S$, $NO_x$, Absolute Pressure, Temperature INLET: Flow Rate, $O_2$, Temperature | ~28 min. | 1, 2C, 3A, 7E, 10, 15/16, 25A, 0010, 0031, ASTM D145 |

The fuel stream from the gasification of the tire 12 was sampled and analyzed for flow rate (velocity), temperature, moisture, molecular weight, heat content, gas density, semi-volatile organics speciation, volatile organics hydrogen sulfide ($H_2S$), carbon monoxide (CO), carbon dioxide ($CO_2$), nitrogen oxides ($NO_x$), total organic carbon (TOC), oxygen ($O_2$), and absolute pressure under varying scenarios. The inlet of the chamber was monitored for flow rate (velocity), temperature, and $O_2$.

The first condition consisted of the introduction of a quarter tire into the gasification unit under a high temperature, low oxygen and high slip stream gas velocity condition. The second condition consisted of the introduction of a whole tire into the tire gasification unit under the same high temperature, converted the non-metallic portion of the tire to a volatile gas and finely sized fixed carbon particles that are high in Btu content. The metallic belts in the tire are not combusted or converted to gas, but rather accumulate at the bottom of the column where they are later removed for recycling.

Figure 3A:
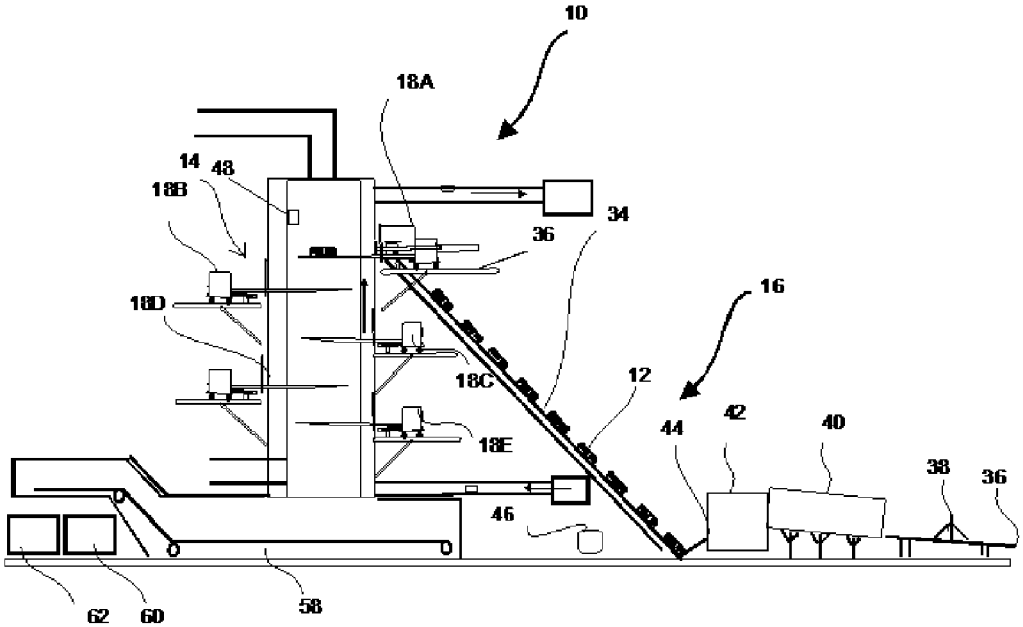
FIG. 3A is another view illustrating the second mode of the invention.
Figure 3B:
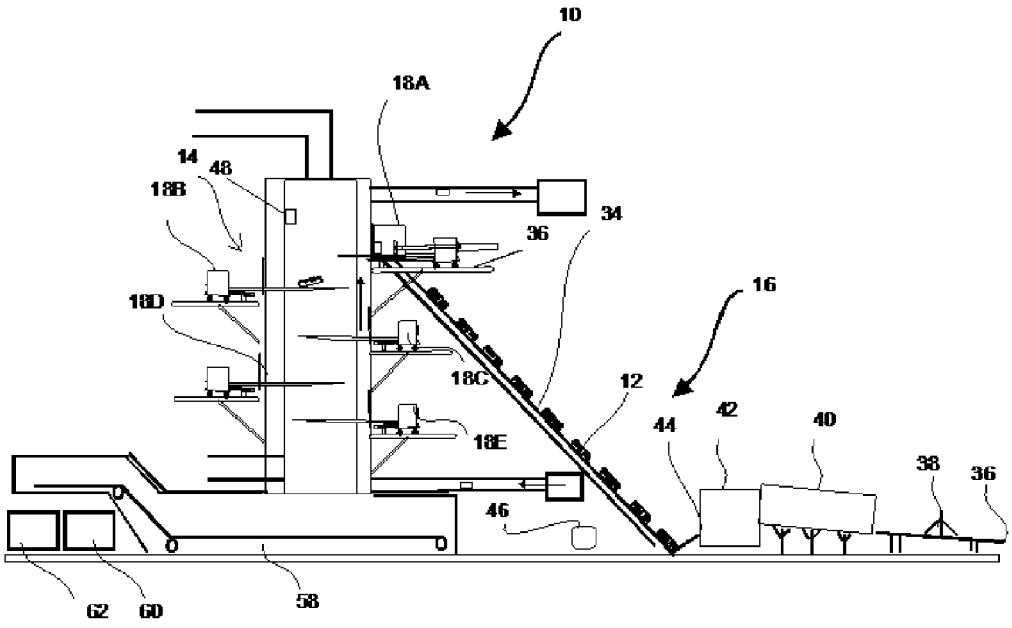
FIG. 3B is a view illustrating a third mode of the support of the instant invention wherein processable material has moved to a lower support.
Figure 3C:
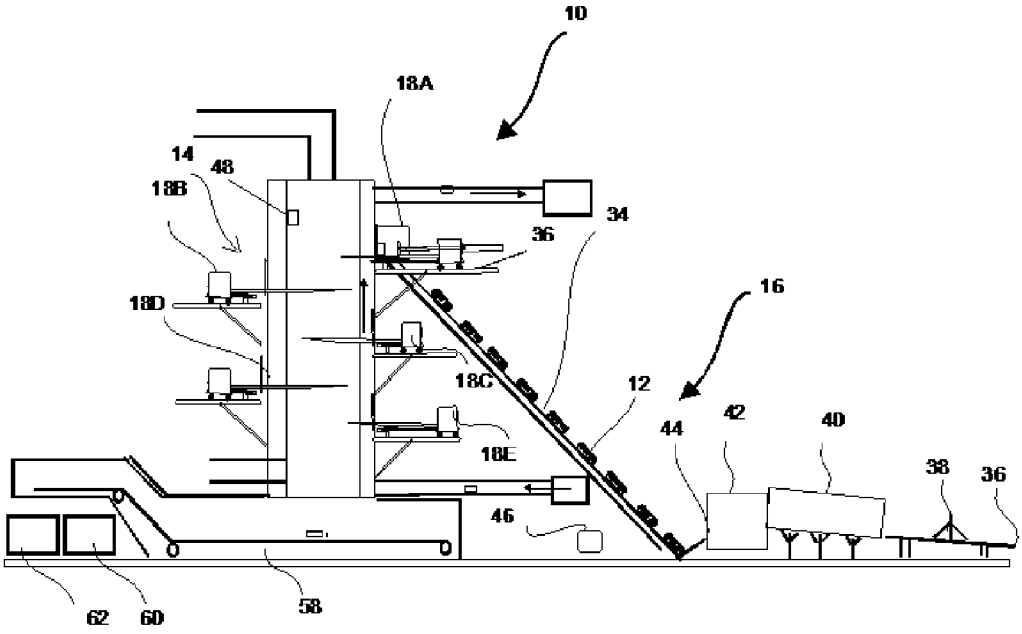
FIG. 3C is a view illustrating a fourth mode of the support of the instant invention wherein material has moved to a recovery conveyor.
Figure 4:
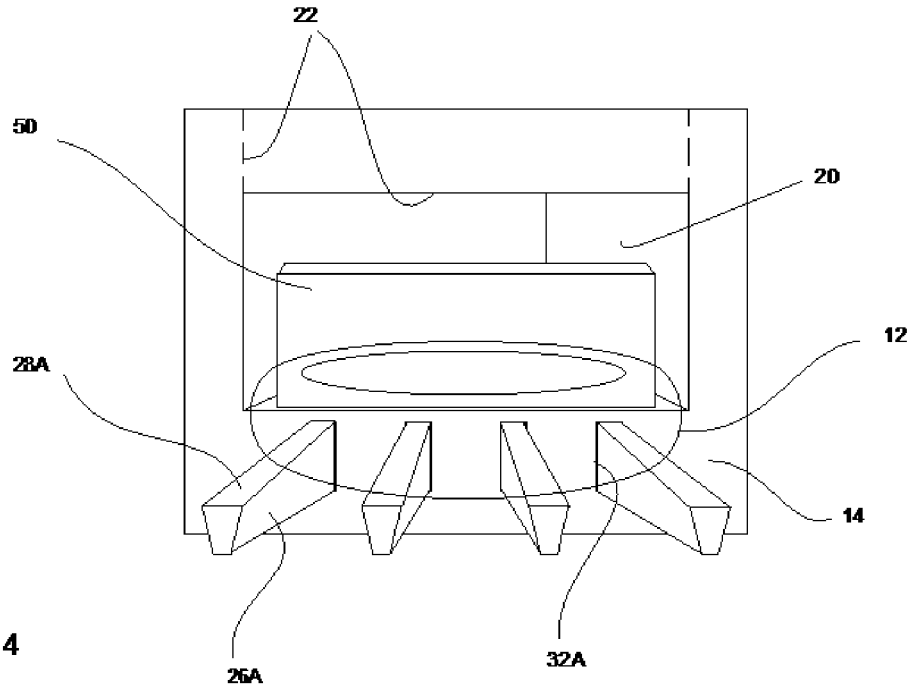
FIG. 4 is a perspective view of a support of the instant invention.
Figure 5:
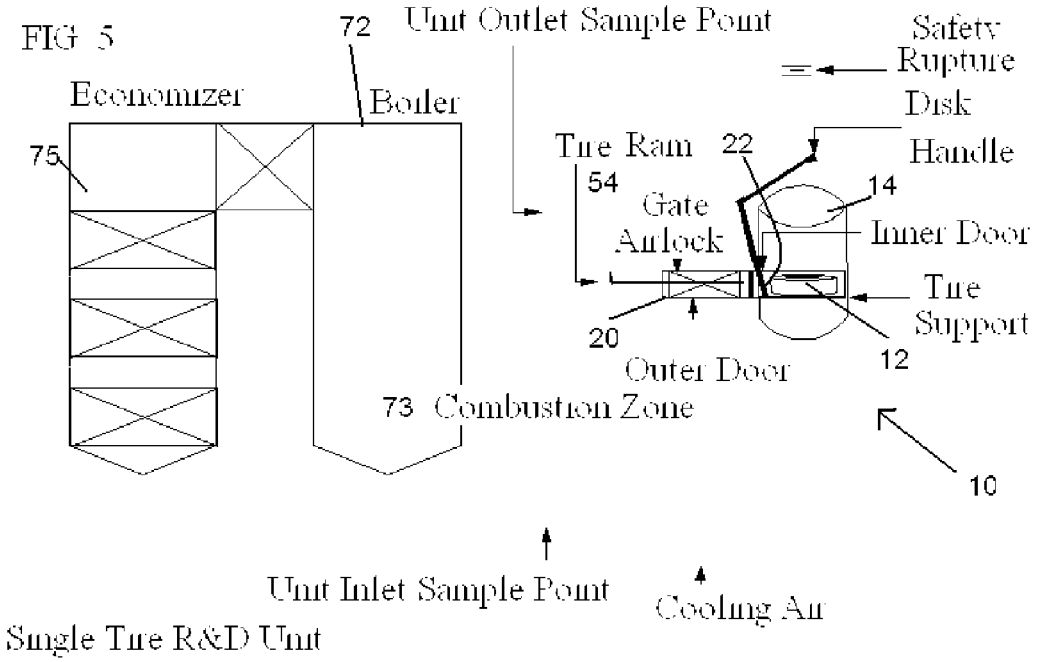
FIG. 5 is a side elevation diagrammatic view embodying the invention test unit.

FIGS. 3A-3C show several of the steps of wherein the tires 12 are processed without burning under low oxygen and residual of tires 12 is further gravity fed, such as to a lower support 18B and ultimately dispensed onto a drop-out conveyor 58 which can be a chain drag out assembly operably disposed in a vessel 59. A water seal 61 can be provided by virtue of inner column wall 80 of column 14 extending below water level. In this way, the introduction of tramp air is isolated from entering the volatizing and fixed carbon formation zone and the system 10 only introduces slip stream air from boiler 72 as is apparent herein. A steel or metal roll-off container 60 and residual ash roll-off container 62 are provided wherein the conveyor 58 can be equipped to automatically separate the residual ash and metal, such as via incorporating a magnetic conveyor.

As generally conceived, first conduit 64 includes a first end 66 which can be communicably connected to a heated air flow path defined by an annular jacket 68 of the suspension column 14 and a second end 70 communicably connected to an outflow air path of a high energy consumption device, such as a boiler 72, wherein air flow passes from the boiler 72 to the jacket 68. A second conduit 74 includes a first end 76 communicably connected to the heated air flow path of the jacket 68 and a second end 78 communicably connected to a return air flow path of the boiler 72 wherein air flow passes from the jacket 68 to the boiler 72. It is contemplated that the column 14 and jacket 68 can be used for hot air, steam or hot oil to recover heat generated.

The embodiment shown in FIG. 1 shows that the suspension column 14 can be equipped with the outer air passage jacket 68 surrounding an inner column wall 80, although it is envisioned that other air channels can be configured. In this way, the air enters the jacket 68 and passes therethrough being heated from the outer surface of the inner wall 80 without mixing gasses from volatizing and fixed carbon formation occurring within the inner wall 80. The system 10 includes air blowers 81 of the type known to circulate air through the described air flow path. Also, vent 82 is provided on the column 14 and conduit 83 connects through jacket 68 to column 14. In this regard, a slip stream of the boiler 72 volatizing and forming fixed carbon can be fed through conduit 83 and fed back to the boiler 72 as described. Thus, heat is recovered from the jacket 68 as well as boiler 72 through reintroduction of volatizing and fixed carbon formation gases and there provides a heat recovery boiler.

Samplings were performed under three different process conditions. The first condition consisted of the introduction of a quarter tire into the gasification unit under a high temperature, low oxygen and high velocity condition. The second condition consisted of the introduction of a whole tire into the tire gasification unit under the same high temperature, low oxygen and high velocity settings conducted during the first condition. The third test condition consisted of the introduction of one whole tire into the unit under high temperature, low oxygen and low airflow conditions. After the first tire was gasified, a second tire was immediately introduced into the unit.

The tire gasification inlet stack was sampled for stack gas velocity, temperature, $O_2$ and $CO_2$ content. The tire gasification outlet stack was sampled for stack gas velocity, temperature, semi-volatile organic compounds, volatile organic compounds, hydrogen sulfide, fuel density, heat content, and gaseous pollutants ($O_2$, $CO_2$, $NO_x$, CO, VOC). Results of the test are as follows.

TABLE 2-1

CHAMBER INLET MINUTE-BY-MINUTE AVERAGES QUARTER TIRE TEST

| Date | Time | $O_2$% | $CO_2$% | Flow, acfm | Temp, ° F. | Comments |
|---|---|---|---|---|---|---|
| Mar. 27, 2007 | 10:40:34 | 4.415 | 14.619 | — | — | Background |
| Mar. 27, 2007 | 10:41:34 | 4.381 | 14.643 | — | — | Background |
| Mar. 27, 2007 | 10:42:35 | 4.435 | 14.597 | — | — | Background |
| Mar. 27, 2007 | 10:43:33 | 4.488 | 14.56 | — | — | Background |
| Mar. 27, 2007 | 10:44:34 | 4.372 | 14.648 | — | — | Background |
| Mar. 27, 2007 | 10:45:35 | 4.578 | 14.461 | — | — | Start Test Run-Quarter Tire in Chamber |
| Mar. 27, 2007 | 10:46:35 | 4.591 | 14.456 | — | — | |
| Mar. 27, 2007 | 10:47:34 | 4.523 | 14.511 | 3,106 | 1148 | Begin Flow Data |
| Mar. 27, 2007 | 10:48:34 | 4.572 | 14.49 | 3,074 | 1148 | |
| Mar. 27, 2007 | 10:49:35 | 4.558 | 14.505 | 3,074 | 1148 | |
| Mar. 27, 2007 | 10:50:33 | 4.549 | 14.505 | 3,058 | 1148 | |
| Mar. 27, 2007 | 10:51:34 | 4.403 | 14.629 | 3,041 | 1148 | |
| Mar. 27, 2007 | 10:52:34 | 4.353 | 14.666 | 3,024 | 1148 | |
| Mar. 27, 2007 | 10:53:35 | 4.335 | 14.676 | 3,058 | 1148 | |
| Mar. 27, 2007 | 10:54:34 | 4.364 | 14.654 | 3,041 | 1148 | |
| Mar. 27, 2007 | 10:55:40 | 4.493 | 14.537 | 3,042 | 1149 | |
| Mar. 27, 2007 | 10:56:34 | 4.516 | 14.525 | 3,043 | 1150 | |
| Mar. 27, 2007 | 10:57:35 | 4.518 | 14.519 | 3,026 | 1150 | |
| Mar. 27, 2007 | 10:58:34 | 4.465 | 14.57 | 2,992 | 1150 | End Flow Data |
| Mar. 27, 2007 | 10:59:34 | 4.547 | 14.504 | — | — | Open Fresh Air Damper |
| Mar. 27, 2007 | 11:00:35 | 5.585 | 13.492 | — | — | |
| Mar. 27, 2007 | 11:01:33 | 9.371 | 10.303 | — | — | |
| Mar. 27, 2007 | 11:02:34 | 6.133 | 13.122 | — | — | |
| Mar. 27, 2007 | 11:03:34 | 7.093 | 12.203 | — | — | |
| Mar. 27, 2007 | 11:04:35 | 7.028 | 12.233 | — | — | |
| Mar. 27, 2007 | 11:05:34 | 6.558 | 12.615 | — | — | |
| Mar. 27, 2007 | 11:06:34 | 6.433 | 12.768 | — | — | |
| Mar. 27, 2007 | 11:07:35 | 6.502 | 12.714 | — | — | |
| Mar. 27, 2007 | 11:08:33 | 6.306 | 12.879 | — | — | |
| Mar. 27, 2007 | 11:09:34 | 19.948 | 0.912 | — | — | |
| Mar. 27, 2007 | 11:10:34 | 20.694 | 0.321 | — | — | |
| Mar. 27, 2007 | 11:11:35 | 20.722 | 0.246 | — | — | |
| Mar. 27, 2007 | 11:12:34 | 20.73 | 0.207 | — | — | |
| Overall Average[a] | | 7.63 | 11.77 | — | — | |
| Gasification Average[b] | | 4.48 | 14.55 | 3,043 | 1,149 | |

[a]Overall Average represents the time the tire was introduced to the chamber until the end of the run.

[b]Average represents the time when gasification began (visual determination) until the fresh air damper was opened.

Note:

Test Scenario was completed at a "High Temperature" and "Low $O_2$".

TABLE 2-2

CHAMBER INLET MINUTE-BY-MINUTE AVERAGES WHOLE TIRE TEST

| Date | Time | $O_2$% | $CO_2$% | Flow, acfm | Temp, ° F. | Comments |
|---|---|---|---|---|---|---|
| Mar. 27, 2007 | 13:26:54 | 3.979 | 15.136 | — | — | Background |
| Mar. 27, 2007 | 13:27:55 | 3.972 | 15.141 | — | — | Background |
| Mar. 27, 2007 | 13:28:55 | 4.169 | 14.964 | — | — | Background |
| Mar. 27, 2007 | 13:29:54 | 4.109 | 15.019 | — | — | Background |
| Mar. 27, 2007 | 13:30:54 | 4.045 | 15.08 | — | — | Background |
| Mar. 27, 2007 | 13:31:55 | 4.198 | 14.941 | — | — | Background |
| Mar. 27, 2007 | 13:32:54 | 4.027 | 15.084 | 3,010 | 1227 | Start Test Run-Whole Tire in chamber |
| Mar. 27, 2007 | 13:33:54 | 4.163 | 14.951 | 3,006 | 1222 | |
| Mar. 27, 2007 | 13:34:55 | 4.02 | 15.072 | 2,969 | 1221 | |
| Mar. 27, 2007 | 13:35:55 | 4.078 | 15.018 | 2,950 | 1220 | |
| Mar. 27, 2007 | 13:36:54 | 3.949 | 15.121 | 2,949 | 1219 | |
| Mar. 27, 2007 | 13:37:55 | 3.983 | 15.089 | 2,914 | 1220 | |
| Mar. 27, 2007 | 13:38:55 | 3.845 | 15.217 | 2,915 | 1221 | |
| Mar. 27, 2007 | 13:39:54 | 3.828 | 15.234 | 2,897 | 1222 | |
| Mar. 27, 2007 | 13:40:54 | 3.75 | 15.293 | 2,899 | 1224 | |
| Mar. 27, 2007 | 13:41:55 | 3.661 | 15.37 | 1,672 | 1016 | |
| Mar. 27, 2007 | 13:42:55 | 3.798 | 15.259 | 286 | 832 | Open Fresh Air Damper |
| Mar. 27, 2007 | 13:43:54 | 17.28 | 3.317 | — | — | |
| Mar. 27, 2007 | 13:44:55 | 20.75 | 0.355 | — | — | |
| Mar. 27, 2007 | 13:45:55 | 20.767 | 0.284 | — | — | |
| Mar. 27, 2007 | 13:46:54 | 20.778 | 0.241 | — | — | |
| Mar. 27, 2007 | 13:47:54 | 20.787 | 0.209 | — | — | |
| Mar. 27, 2007 | 13:48:55 | 20.792 | 0.189 | — | — | |
| Mar. 27, 2007 | 13:49:55 | 20.799 | 0.172 | — | — | |
| Mar. 27, 2007 | 13:50:54 | 20.805 | 0.162 | — | — | |
| Mar. 27, 2007 | 13:51:55 | 20.812 | 0.152 | — | — | |
| Mar. 27, 2007 | 13:52:55 | 20.816 | 0.144 | — | — | |
| Mar. 27, 2007 | 13:53:54 | 20.819 | 0.138 | — | — | |
| Overall Average[a] | | 3.92 | 15.16 | — | — | |
| Gasification Average[b] | | 20.47 | 0.49 | 2,588 | 1,168 | |

[a]Overall Average represents the time the tire was introduced to the chamber until the end of the run.

[b]Average represents the time when gasification began (visual determination) until the fresh air damper was opened.

Note:

Test Scenario was completed at a "High Temperature" and "Low $O_2$".

35

TABLE 2-3

CHAMBER INLET MINUTE-BY-MINUTE AVERAGES
WHOLE TIRE SECOND TEST DAY

Date: Mar. 28, 2007 Recyclean-Miamisburg, Ohio

| Date | Time | $O_2$% | $CO_2$% | Flow, acfm | Temp, ° F. | Comments |
|---|---|---|---|---|---|---|
| Mar. 28, 2007 | 10:44:37 | 4.134 | 14.871 | — | — | Background |
| Mar. 28, 2007 | 10:45:38 | 4.158 | 14.847 | — | — | Background |
| Mar. 28, 2007 | 10:46:36 | 4.194 | 14.807 | — | — | Background |
| Mar. 28, 2007 | 10:47:37 | 4.289 | 14.725 | — | — | Background |
| Mar. 28, 2007 | 10:48:37 | 4.262 | 14.726 | — | — | Background |
| Mar. 28, 2007 | 10:49:38 | 4.303 | 14.684 | — | — | Start Test Run-Whole Tire in Chamber |
| Mar. 28, 2007 | 10:50:36 | 4.476 | 14.51 | 1,782 | 1196 | |
| Mar. 28, 2007 | 10:51:37 | 5.656 | 13.495 | 1,781 | 1195 | |
| Mar. 28, 2007 | 10:52:37 | 6.197 | 13.004 | 1,781 | 1195 | |
| Mar. 28, 2007 | 10:53:38 | 7.526 | 11.832 | 1,751 | 1194 | |
| Mar. 28, 2007 | 10:54:36 | 9.675 | 9.928 | 1,720 | 1193 | |
| Mar. 28, 2007 | 10:55:37 | 10.852 | 8.914 | 1,688 | 1192 | |
| Mar. 28, 2007 | 10:56:37 | 11.092 | 8.672 | 1,656 | 1191 | |
| Mar. 28, 2007 | 10:57:36 | 11.825 | 8.026 | 1,623 | 1189 | |
| Mar. 28, 2007 | 10:58:37 | 12.127 | 7.753 | 1,622 | 1187 | |
| Mar. 28, 2007 | 10:59:37 | 12.372 | 7.529 | 1,654 | 1187 | Second Tire-Whole Tire in Chamber |
| Mar. 28, 2007 | 11:00:38 | 12.521 | 7.392 | 1,622 | 1187 | |
| Mar. 28, 2007 | 11:01:36 | 7.717 | 11.697 | 1612 | 1166 | |
| Mar. 28, 2007 | 11:02:37 | 5.333 | 13.856 | 1,582 | 1173 | |
| Mar. 28, 2007 | 11:03:37 | 4.353 | 14.77 | 1,640 | 1159 | |
| Mar. 28, 2007 | 11:04:36 | 4.34 | 14.788 | 1,681 | 1179 | |
| Mar. 28, 2007 | 11:05:37 | 4.382 | 14.752 | 1,682 | 1181 | |
| Mar. 28, 2007 | 11:06:37 | 4.44 | 14.694 | 1,619 | 1181 | |
| Mar. 28, 2007 | 11:07:38 | 4.332 | 14.796 | 1,518 | 1180 | |
| Mar. 28, 2007 | 11:08:36 | 4.519 | 14.622 | 1,368 | 1171 | |
| Mar. 28, 2007 | 11:09:37 | 4.571 | 14.549 | 1,289 | 1169 | |

TABLE 2-3-continued

CHAMBER INLET MINUTE-BY-MINUTE AVERAGES
WHOLE TIRE SECOND TEST DAY

Date: Mar. 28, 2007 Recyclean-Miamisburg, Ohio

| Date | Time | $O_2$% | $CO_2$% | Flow, acfm | Temp, ° F. | Comments |
|---|---|---|---|---|---|---|
| Mar. 28, 2007 | 11:10:37 | 4.445 | 14.667 | 1,328 | 1168 | |
| Mar. 28, 2007 | 11:11:36 | 4.573 | 14.551 | 1,404 | 1168 | |
| Mar. 28, 2007 | 11:12:37 | 4.349 | 14.761 | 1,613 | 1170 | Open Fresh Air Damper |
| Mar. 28, 2007 | 11:13:37 | 4.259 | 14.84 | 1,479 | 1173 | |
| Mar. 28, 2007 | 11:14:38 | 4.123 | 14.967 | 1,444 | 1174 | |
| Mar. 28, 2007 | 11:15:36 | 4.244 | 14.827 | — | — | |
| Overall Average[a] | | 6.61 | 12.70 | — | — | |
| Gasification Average[b] | | 7.03 | 12.33 | 1,598 | 1,181 | |

[a]Overall Average represents the time the tire was introduced to the chamber until the end of the run.
[b]Average represents the time when gasification began (visual determination) until the fresh air damper was opened.
Note:
Test Scenario was completed at a "High Temperature", "Low $O_2$" and "Low Flow".

TABLE 2-4

CHAMBER OUTLET GASEOUS POLLUTANTS MINUTE-BY-MINUTE AVERAGES QUARTER TIRE TEST

| Date | Time | $O_2$, % | $CO_2$, % | CO, ppm | THC, ppm | $NO_x$, ppm | Flow, acfm | Temp, ° F. | Comments |
|---|---|---|---|---|---|---|---|---|---|
| Mar. 27, 2007 | 10:40:37 | 8.267 | 11.726 | 427.6 | 12 | 123.7 | — | — | Background |
| Mar. 27, 2007 | 10:41:37 | 8.279 | 11.718 | 488.5 | 12 | 124.8 | — | — | Background |
| Mar. 27, 2007 | 10:42:37 | 8.288 | 11.719 | 461.9 | 12 | 127.2 | — | — | Background |
| Mar. 27, 2007 | 10:43:37 | 8.343 | 11.695 | 415.4 | 12 | 127.9 | — | — | Background |
| Mar. 27, 2007 | 10:44:37 | 8.231 | 11.8 | 393.3 | 11.9 | 129.8 | — | — | Background |
| Mar. 27, 2007 | 10:45:37 | 8.436 | 11.641 | 314.9 | 12 | 131.4 | — | — | Background |
| Mar. 27, 2007 | 10:46:35 | 8.441 | 11.649 | 276.4 | 12.5 | 132.3 | — | — | Start Test Run-Quarter Tire in Chamber |
| Mar. 27, 2007 | 10:47:35 | 8.314 | 11.747 | 318.1 | 17.7 | 128.5 | — | — | |
| Mar. 27, 2007 | 10:48:35 | 8.351 | 11.711 | 317.4 | 43.1 | 131.6 | 2,807 | 785 | |
| Mar. 27, 2007 | 10:49:35 | 8.299 | 11.732 | 407.1 | 162.6 | 130.6 | 2,807 | 785 | |
| Mar. 27, 2007 | 10:50:35 | 8.252 | 11.717 | 602.9 | 544.4 | 127.5 | 2,930 | 773 | |
| Mar. 27, 2007 | 10:51:35 | 8.135 | 11.807 | 791 | 640.4 | 125.2 | 2,930 | 773 | |
| Mar. 27, 2007 | 10:52:36 | 8.037 | 11.864 | 981.3 | 699.6 | 124.4 | 2,930 | 773 | |
| Mar. 27, 2007 | 10:53:36 | 8.017 | 11.853 | 1301.5 | 1518 | 120.6 | 2,930 | 773 | |
| Mar. 27, 2007 | 10:54:36 | 8.004 | 11.831 | 1462.3 | 1668 | 120.1 | 2,935 | 777 | |
| Mar. 27, 2007 | 10:55:36 | 8.063 | 11.829 | 1463.2 | 1192 | 122.9 | 2,935 | 777 | |
| Mar. 27, 2007 | 10:56:36 | 8.237 | 11.768 | 892.9 | 235.4 | 134.6 | 2,942 | 783 | |
| Mar. 27, 2007 | 10:57:36 | 8.276 | 11.779 | 674.9 | 181.4 | 136.5 | 2,942 | 783 | |
| Mar. 27, 2007 | 10:58:36 | 8.217 | 11.845 | 602.8 | 118.7 | 133.3 | 2,947 | 787 | |
| Mar. 27, 2007 | 10:59:36 | 8.482 | 11.622 | 568.8 | 92.8 | 132.4 | 2,947 | 787 | Open Fresh Air Damper |
| Mar. 27, 2007 | 11:00:36 | 15.388 | 5.589 | 635.8 | 84.5 | 118.3 | 2,948 | 788 | |
| Mar. 27, 2007 | 11:01:36 | 20.727 | 0.833 | 554 | 74.7 | 17.7 | 2,948 | 788 | |
| Mar. 27, 2007 | 11:02:36 | 20.4 | 1.108 | 474.9 | 64.5 | 7.8 | 2,949 | 789 | |
| Mar. 27, 2007 | 11:03:36 | 20.305 | 1.217 | 397.4 | 58.1 | 9.3 | 2,949 | 789 | |
| Mar. 27, 2007 | 11:04:36 | 20.187 | 1.347 | 344.3 | 53.7 | 10.1 | 3,878 | 620 | |
| Mar. 27, 2007 | 11:05:36 | 20.035 | 1.501 | 278.6 | 51.1 | 10.6 | 3,878 | 620 | |
| Mar. 27, 2007 | 11:06:36 | 20.011 | 1.518 | 194 | 49.6 | 11.6 | 3,906 | 504 | |
| Mar. 27, 2007 | 11:07:36 | 20.043 | 1.484 | 147.4 | 48.9 | 11.3 | 3,906 | 504 | |
| Mar. 27, 2007 | 11:08:36 | 20.093 | 1.431 | 143.7 | 50.4 | 11.3 | 3,808 | 421 | |
| Mar. 27, 2007 | 11:09:36 | 21.234 | 0.41 | 80.5 | 53.8 | 7.3 | 3,808 | 421 | |
| Mar. 27, 2007 | 11:10:36 | 21.234 | 0.401 | 73.2 | 52.3 | 0.7 | 3,775 | 374 | |
| Mar. 27, 2007 | 11:11:36 | 21.236 | 0.397 | 71.1 | 51.4 | 0.4 | 3,775 | 374 | |
| Mar. 27, 2007 | 11:12:37 | 21.237 | 0.396 | 67.4 | 66.9 | 0.5 | 3,730 | 298 | |
| Overall Average[a] | | 13.97 | 6.76 | 523.07 | 292.09 | 74.72 | — | — | |
| Gasification Average[b] | | 8.22 | 11.77 | 761.47 | 509.04 | 128.61 | 3,250 | 666 | |

[a]Overall Average represents the time the tire was introduced to the chamber until the end of the run.
[b]Average represents the time when gasification began (visual determination) until the fresh air damper was opened.
Note:
Test Scenario was completed at a "High Temperature" and "Low $O_2$".

TABLE 2-5

CHAMBER OUTLET GASEOUS POLLUTANTS MINUTE-BY-MINUTE AVERAGES WHOLE TIRE TEST

| Date | Time | $O_2$, % | $CO_2$, % | CO, ppm | THC, ppm | $NO_x$, ppm | Flow, acfm | Temp, ° F. | Comments |
|---|---|---|---|---|---|---|---|---|---|
| Mar. 27, 2007 | 13:27:58 | 8.586 | 11.671 | 139.8 | 1 | 151.6 | — | — | Background |
| Mar. 27, 2007 | 13:28:58 | 8.687 | 11.573 | 127.7 | 1 | 151.3 | — | — | Background |
| Mar. 27, 2007 | 13:29:58 | 8.661 | 11.616 | 142.1 | 0.9 | 151.8 | — | — | Background |

TABLE 2-5-continued

CHAMBER OUTLET GASEOUS POLLUTANTS MINUTE-BY-MINUTE AVERAGES WHOLE TIRE TEST

| Date | Time | $O_2$, % | $CO_2$, % | CO, ppm | THC, ppm | $NO_x$, ppm | Flow, acfm | Temp, ° F. | Comments |
|---|---|---|---|---|---|---|---|---|---|
| Mar. 27, 2007 | 13:30:58 | 8.609 | 11.683 | 119 | 0.9 | 157.2 | — | — | Background |
| Mar. 27, 2007 | 13:31:58 | 8.786 | 11.528 | 115.3 | 0.8 | 156.9 | — | — | Background |
| Mar. 27, 2007 | 13:32:58 | 8.618 | 11.662 | 133.3 | 1.1 | 151.7 | — | — | Start Test Run-Whole Tire |
| Mar. 27, 2007 | 13:33:58 | 8.642 | 11.603 | 315.7 | 111.5 | 151.5 | — | — | |
| Mar. 27, 2007 | 13:34:59 | 8.414 | 11.727 | 1055.2 | 5958 | 148.7 | 3,003 | 835 | |
| Mar. 27, 2007 | 13:35:59 | 8.13 | 11.77 | 2519.7 | 3286 | 123.7 | 3,003 | 835 | |
| Mar. 27, 2007 | 13:36:59 | 7.729 | 11.91 | 3873.7 | 4464 | 126.6 | 2,998 | 831 | |
| Mar. 27, 2007 | 13:37:59 | 7.191 | 11.983 | 4996.7 | 7880 | 122.9 | 2,998 | 831 | |
| Mar. 27, 2007 | 13:38:59 | 7.152 | 12.13 | 5019.2 | 9673 | 145.5 | 3,006 | 838 | |
| Mar. 27, 2007 | 13:39:59 | 7.105 | 12.152 | 5011.3 | 11041 | 169.3 | 3,006 | 838 | |
| Mar. 27, 2007 | 13:40:59 | 7.049 | 12.27 | 5018.2 | 9745 | 223.9 | 3,035 | 863 | |
| Mar. 27, 2007 | 13:41:59 | 7.355 | 12.316 | 4743.1 | 489.6 | 223.2 | 3,035 | 863 | |
| Mar. 27, 2007 | 13:42:59 | 9.481 | 10.643 | 4056.7 | 2589 | 191.2 | 3,060 | 885 | Open Fresh Air Damper |
| Mar. 27, 2007 | 13:43:59 | 19.969 | 1.736 | 2108.3 | 655.3 | 133.3 | 3,060 | 885 | |
| Mar. 27, 2007 | 13:44:59 | 20.559 | 1.093 | 1558.4 | 585.3 | 40.9 | 3,066 | 890 | |
| Mar. 27, 2007 | 13:45:59 | 20.726 | 0.962 | 1512.3 | 474.7 | 20.1 | 3,066 | 890 | |
| Mar. 27, 2007 | 13:46:59 | 20.873 | 0.854 | 1258.9 | 405.4 | 13.6 | 4,200 | 780 | |
| Mar. 27, 2007 | 13:47:57 | 21.01 | 0.745 | 1058.1 | 351.4 | 9.7 | 4,200 | 780 | |
| Mar. 27, 2007 | 13:48:57 | 21.102 | 0.652 | 864 | 300.6 | 7.1 | 3,969 | 622 | |
| Mar. 27, 2007 | 13:49:57 | 21.186 | 0.614 | 682 | 265.6 | 6 | 3,969 | 622 | |
| Mar. 27, 2007 | 13:50:57 | 21.216 | 0.569 | 535.7 | 236.4 | 4.7 | 3,971 | 498 | |
| Mar. 27, 2007 | 13:51:57 | 21.264 | 0.554 | 466.4 | 211 | 4 | 3,971 | 498 | |
| Mar. 27, 2007 | 13:52:57 | 21.295 | 0.53 | 340.1 | 192.2 | 3.3 | — | — | |
| Mar. 27, 2007 | 13:53:57 | 21.314 | 0.515 | 258.4 | 176.4 | 3 | — | — | |
| Overall Average[a] | | 14.43 | 6.32 | 2153.88 | 2686.02 | 92.00 | — | — | |
| Gasification Average[b] | | 7.74 | 11.95 | 3268.61 | 5264.92 | 158.70 | 3,368 | 782 | |

[a]Overall Average represents the time the tire was introduced to the chamber until the end of the run.

[b]Average represents the time when gasification began (visual determination) until the fresh air damper was opened.

Note:

Test Scenario was completed at a "High Temperature" and "Low $O_2$"

TABLE 2-6

CHAMBER OUTLET GASEOUS POLLUTANTS MINUTE-BY-MINUTE AVERAGES WHOLE TIRE TEST

| Date | Time | $O_2$, % | $CO_2$, % | CO, ppm | THC, ppm | $NO_x$, ppm | Flow, acfm | Temp ° F. | Comments |
|---|---|---|---|---|---|---|---|---|---|
| Mar. 28, 2007 | 10:45:00 | 9.908 | 10.1 | 55.3 | 5.22 | 136.7 | — | — | Background |
| Mar. 28, 2007 | 10:46:00 | 9.932 | 10.08 | 58.4 | 4.95 | 132.9 | — | — | Background |
| Mar. 28, 2007 | 10:47:00 | 9.985 | 10.018 | 57.3 | 37.67 | 132.3 | — | — | Background |
| Mar. 28, 2007 | 10:48:00 | 9.95 | 10.077 | 56.1 | 11.27 | 133.1 | — | — | Background |
| Mar. 28, 2007 | 10:49:00 | 9.905 | 10.06 | 92.2 | 69.3 | 138.2 | — | — | Background |
| Mar. 28, 2007 | 10:50:00 | 10.491 | 9.563 | 243.7 | 199.925 | 128.8 | 1,753 | 731 | Background |
| Mar. 28, 2007 | 10:51:00 | 9.874 | 10.052 | 581.5 | 626.725 | 134.9 | 1,710 | 733 | Background |
| Mar. 28, 2007 | 10:52:00 | 9.592 | 10.251 | 1044.4 | 1414.6 | 129 | 1,733 | 734 | Start Test Run-Whole Tire in Chamber |
| Mar. 28, 2007 | 10:53:00 | 9.392 | 10.302 | 1483.2 | 2590.225 | 128.7 | 1,711 | 734 | |
| Mar. 28, 2007 | 10:54:00 | 9.267 | 10.297 | 2265.9 | 5085.025 | 128.6 | 1,692 | 739 | |
| Mar. 28, 2007 | 10:55:00 | 8.759 | 10.427 | 3752.9 | 9686.6 | 125.7 | 1,694 | 743 | |
| Mar. 28, 2007 | 10:56:00 | 8.523 | 10.53 | 4535.3 | 11181.78 | 130 | 1,653 | 750 | |
| Mar. 28, 2007 | 10:57:00 | 8.369 | 10.417 | 4951.5 | 15271.03 | 145.1 | 1,669 | 774 | |
| Mar. 28, 2007 | 10:58:00 | 7.53 | 10.813 | 5008.1 | 17387.98 | 187.3 | 1,694 | 776 | |
| Mar. 28, 2007 | 10:59:00 | 7.647 | 10.902 | 5011.6 | 13575.1 | 266.3 | 1,695 | 778 | Second Tire-Whole tire in Chamber |
| Mar. 28, 2007 | 11:00:00 | 8.814 | 10.578 | 4431 | 8627.025 | 237.5 | 1,694 | 776 | |
| Mar. 28, 2007 | 11:01:00 | 8.278 | 10.623 | 4997.8 | 6133.875 | 199.4 | 1,711 | 766 | |
| Mar. 28, 2007 | 11:02:00 | 11.294 | 8.553 | 3858 | 2660.9 | 153.8 | 1,710 | 765 | |
| Mar. 28, 2007 | 11:03:00 | 10.172 | 9.458 | 3649.4 | 3766.95 | 135.8 | 1,711 | 766 | |
| Mar. 28, 2007 | 11:04:01 | 8.862 | 10.505 | 4169 | 4712.4 | 137.7 | 1,689 | 769 | |
| Mar. 28, 2007 | 11:05:01 | 8.493 | 10.597 | 4855 | 6993.525 | 138.5 | 1,691 | 772 | |
| Mar. 28, 2007 | 11:06:01 | 8.31 | 10.557 | 5005.2 | 9326.35 | 142.9 | 1,671 | 111 | |
| Mar. 28, 2007 | 11:07:01 | 8.029 | 10.657 | 5005.9 | 10732.98 | 155.7 | 1,477 | 794 | |
| Mar. 28, 2007 | 11:07:59 | 7.71 | 10.722 | 5006.9 | 11931.7 | 179.5 | 1,443 | 832 | |
| Mar. 28, 2007 | 11:08:59 | 3.357 | 13.846 | 5010 | 6190.8 | 251.5 | 1,469 | 879 | |
| Mar. 28, 2007 | 11:09:59 | 2.6 | 15.596 | 4274.2 | 1596.65 | 324.9 | 1,512 | 903 | |
| Mar. 28, 2007 | 11:10:59 | 3.761 | 14.928 | 390.8 | 1679.7 | 264.1 | 1,645 | 939 | |
| Mar. 28, 2007 | 11:11:59 | 5.806 | 13.247 | 208.5 | 826.375 | 207 | 1,879 | 944 | |
| Mar. 28, 2007 | 11:12:59 | 7.95 | 11.138 | 3397.5 | 1116.225 | 156.5 | 1,897 | 934 | Open Fresh Air Damper |
| Mar. 28, 2007 | 11:13:59 | 8.899 | 10.51 | 4925.8 | 1362.9 | 158.2 | 1,936 | 923 | |
| Mar. 28, 2007 | 11:14:59 | 9.252 | 10.37 | 3859.9 | 1125.025 | 138.4 | — | — | |
| Mar. 28, 2007 | 11:15:59 | 9.374 | 10.355 | 3042.9 | 890.725 | 134.7 | — | — | |
| Mar. 28, 2007 | 11:16:59 | 10.07 | 9.627 | 1897.5 | 630.575 | 121.2 | — | — | |

TABLE 2-6-continued

CHAMBER OUTLET GASEOUS POLLUTANTS MINUTE-BY-MINUTE AVERAGES WHOLE TIRE TEST

| Date | Time | $O_2$, % | $CO_2$, % | CO, ppm | THC, ppm | $NO_x$, ppm | Flow, acfm | Temp ° F. | Comments |
|---|---|---|---|---|---|---|---|---|---|
| Mar. 28, 2007 | 11:17:59 | 20.384 | 0.702 | 4.8 | 391.325 | 1.3 | — | — | |
| Overall Average[a] | | 8.65 | 10.56 | 3340.28 | 5438.45 | 163.55 | — | — | |
| Gasification Average[b] | | 8.04 | 11.02 | 3466.95 | 6617.31 | 175.33 | 1,688 | 801 | |

[a]Overall Average represents the time the tire was introduced to the chamber until the end of the run.
[b]Average represents the time when gasification began (visual determination) until the fresh air damper was opened.

The invention thus provides for recovery the energy in the tire via gasification of the tire under low oxygen, high velocity and approximately 1,100° F. conditions. The present system 10 can extract the slip stream gas from the boiler's economizers 75 at one or more points in order to be able to temper the inlet temperature and use the waste heat and low oxygen of the existing process to supply the operating conditions desired. An induced draft fan 77 can be installed where needed, e.g., on the exit side of the single tire column, to pull the hot gasses through the column and force the fuel gas and fixed carbon into the combustion zone 73 of the boiler 72.

Several tests were performed. The first day of operation the unit was run in a high velocity mode. The second day, the velocity was reduced in order to collect data on how important the velocity was to the process.

With a quarter tire weighing 3.6 pounds, under 4% oxygen and a gas stream of 1,149° F., the tire was reduced to 0.40 pounds of steel (88.88% reduction) in 10 minutes. All of the heat value of the tire was passed into the boiler's combustion zone 73 including both the vapor and fixed carbon.

A whole tire weighing 18.68 pounds was then introduced into the unit and under 4% oxygen and a gas stream of 1,168° F., it was reduced to 1.96 pounds of steel (92.40% reduction) in 9 minutes. The liberation of the fixed carbon from the steel in the tire was stopped and 1.42 pounds of fixed carbon char ash was collected and analyzed. The heat value of the material was 4,867 BTU/pound.

The next day two tires, totaling 37.48 pounds, were introduced 11 minutes apart into 4% oxygen and 1,181° F. conditions. The two tires were reduced to 3.72 pounds of steel (90.07% reduction) in 23 minutes.

Observations

It is found that the low oxygen conditions did not allow for the waste processable products in the tires 12 to burn. It is also found that the elevated temperatures were adequate to vaporize the organic volatile component in the rubber. Finally, it is found that high velocities were necessary in order to draw the fixed carbon component of the tires 12 off of the tire wire, out of the single tire test column 14 and into the combustion zone 73 of the boiler. Thus the radiant energy of the tire was recovered in the boiler 72, no ash was left in the column 14 and a higher quality of steel was produced. The invention thus provided a new process "tire fractionation."

It was also observed that the process proceeded in four individual steps:

1) HEAT 2) DRY 3) VOLATILIZE 4) FIXED CARBON FORMATION

It is determined that under the correct conditions the rate at which the tires 12 fractionate are independent of their weights. (In other words, the quarter tire broke down in the same amount of time as the whole tire.) In general they follow the following timings:

| | |
|---|---|
| Heat | 1 Minute |
| Dry | 1-2 Minutes |
| Volatilize | 2-3 Minutes |
| Fixed Carbon Formation | 5 Minutes |
| Start to Finish | 9-11 Minutes |

Also a sample of the char produced by the process was collected and analyzed. It contained no detectable Mercury, 12,300 mg/Kg of Zinc, as expected, and conformed to EPA standards for metals, VOC and SVOC TCLP testing. No apparent reason exists that the ash from the fixed carbon char when added to the boiler's ash would be detrimental to the boilers operation such as a slagging factor.

This test showed that tires 12 can be fractionated under low oxygen and high temperature, approximately 1,100° F. conditions, producing a gaseous and solid fuel for the boiler while producing no negative effects to the boiler and generating a high quality of recyclable steel.

In one aspect of the invention, the gasses generated from the tires 12 can be concentrated by refluxing a portion of the overhead stream back into the vaporization zone 102 of the column 14. Also, the fixed carbon fraction can be separated from the overhead stream by an inline cyclone 85 and then reintroduced into the fuel feed duct 92 to the boiler 72 or can be collected for the further recovery of metals in the char such as zinc. A delumper or grinder 94 will be located at the bottom of the cyclone 85 in order to size the solids before they are sent to the boiler 72 for optimum combustion.

Because tires 12, with the exception of a higher BTU value and a higher Zinc content, compare favorable with coal, Tire Derived Fuel (TDF) is being successfully utilized worldwide as a supplemental fuel in coal burning operations.

Fractionated tire fuel has many advantages as a supplemental boiler fuel. It is an excellent use of a waste product that otherwise presents many environmental problems, and can result in reduced emissions from utility boilers. It is a source of energy that is cleaner than coal and does not involve combustion of fossil fuels, thereby contributing to energy diversity and reduced emission of greenhouse gases.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. An energy recovery system for whole tires, which includes a suspension column which is maintained under low oxygen to enable fractionization of at least one of the whole tires;

wherein said suspension column enables gasifying the whole tires into fuel gas and fixed carbon char by an entering stream of high temperature gas having a sub-stoichiometric low oxygen content to preclude combustion of the whole tires therein while causing volatiles to gasify, wherein said entering stream of high temperature gas temperature is at least about 700° F. and oxygen content is less than 10%;

a receiving mechanism which includes a plurality of suspension supports in said suspension column for receiving the at least one of the whole tires onto one of said suspension supports upwardly disposed within said column and feeding said tire undergoing gasification and steel to an adjacent downwardly disposed suspending support to liberate fixed carbon char therefrom wherein all said char is entrained in said stream of gas for exiting up and out of said suspension column; and a boiler operably connected to said suspension column to receive and deliver fluid flow thereto; and a fluid flow mover operably interconnecting an exit side of said suspension column with said boiler and which provides sufficient fluid force to pull and deliver fuel gas and said entrained fixed carbon char thereto out of said suspension column.

2. The energy recovery system for whole tires of claim 1, wherein said suspension column includes at least one airlock for receiving at least one of said whole tires and for removing residuals from said column.

3. The energy recovery system for whole tires of claim 2, which includes a cyclone operably connected to said column.

4. The energy recovery system for whole tires of claim 3, which includes a carbon dioxide removal device operably connected to said cyclone and said column.

5. The energy recovery system for whole tires of claim 3, which includes a boiler having a combustion zone and an economizer zone, said boiler operably connected to said cyclone and said suspension column.

6. The energy recovery system for whole tires of claim 1, wherein said suspension supports are spaced from one another along a length of said suspension column.

7. The energy recovery system for whole tires of claim 1, wherein said fluid flow mover includes a fan for affecting gas flow rate.

8. The energy recovery system for whole tires of claim 1, wherein said gasifying apparatus includes a first conduit having a first end communicably connected to a heated air path of said suspension column and a second end communicably connected to an outflow air path of a high energy consumption device wherein air flow passes from said outflow air path of said high energy consumption device to heated air flow path of said suspension column, and a second conduit having a first end communicably connected to said heated air flow path of said suspension column and a second end communicably connected to a return air flow path of said high energy consumption device wherein air flow passes from said heated air flow path of said suspension column to said return air flow path of said high energy consumption device.

9. The energy recovery system for whole tires of claim 8, wherein said suspension column includes an outer air passage jacket surrounding an inner column wall to which said first and second conduits are communicably connected such that said air enters said jacket and passes through said jacket being heated from an outer surface of said inner wall without mixing with air volatizing and fixed carbon formation occurring within said inner wall.

10. The energy recovery system for whole tires of claim 9, which further includes air movers for circulating said air through said jacket.

11. The energy recovery system for whole tires of claim 1, further including an airlock for removing residual and non-processable waste materials from said suspension column.

12. The energy recovery system for whole tires of claim 11, which further includes a conveyor system operably disposed adjacent downwardly in said suspension column.

13. The energy recovery system for whole tires of claim 12, wherein said conveyor system includes a magnetic conveyor.

14. The energy recovery system for whole tires of claim 1, wherein each suspension support includes a plurality of support fingers each having a fuel support surface which is removably disposed in said suspension column to provide for self cleaning of said support surface of said fingers upon removal from said suspension column.

15. The energy recovery system for whole tires of claim 14, wherein said suspension support includes apparatus for automatically retracting said fingers from said column.

16. The energy recovery system for whole tires of claim 1, which further includes apparatus for automatically feeding at least one said whole tire onto said suspension supports.

17. The energy recovery system for whole tires of claim 1, wherein said oxygen content is less than 5%.

* * * * *